US005584789A

United States Patent [19]

Robertson

[11] Patent Number: 5,584,789

[45] Date of Patent: Dec. 17, 1996

[54] METHOD AND APPARATUS FOR FORMING NON-ROUND CONTAINERS

[75] Inventor: Ronald D. Robertson, Kansas City, Mo.

[73] Assignee: Sealright Co., Inc., Desoto, Kans.

[21] Appl. No.: 301,338

[22] Filed: Sep. 6, 1994

[51] Int. Cl.[6] ..... B31B 1/28; B31B 1/64

[52] U.S. Cl. ..... 493/153; 156/218; 493/295; 493/176

[58] Field of Search ..... 493/104–109, 493/164, 165, 166, 175, 176, 153, 154, 155, 295, 296, 308, 297; 156/443, 218, 568

[56] References Cited

U.S. PATENT DOCUMENTS

| | | | |
|---|---|---|---|
| 1,876,931 | 9/1932 | Heywood | 493/106 |
| 2,545,292 | 3/1951 | Magnusson . | |
| 2,819,659 | 1/1958 | Scott | 493/106 |
| 2,936,681 | 5/1960 | Earp . | |
| 3,847,540 | 11/1974 | Farfaglia et al. . | |
| 3,958,501 | 5/1976 | Richards . | |
| 4,242,949 | 7/1981 | Auckenthaler | 493/295 |
| 4,349,345 | 9/1982 | Bodendoefer | 493/164 |
| 4,846,625 | 7/1989 | Gabillet . | |
| 4,925,440 | 5/1990 | Muller . | |
| 5,020,986 | 6/1991 | Reil | 493/105 |

*Primary Examiner*—Jack W. Lavinder

[57] ABSTRACT

In a non-round container forming machine having a device for receiving and delivering flat container wall blanks to a wrapping station, at which the blanks are wrapped around a non-round mandrel. The non-round mandrel has a front end facing the blank. The blank is aligned substantially tangential to the mandrel when delivered to the wrapping station. A wing slide assembly, within the wrapping station, moves linearly along opposite sides of the mandrel in a wrapping direction substantially perpendicular to the blank to fold the blank along opposite sides of the mandrel. A forward wing clamp assembly, within the wrapping station, is mounted proximate a rear end of the mandrel to move pivotally to engage and direct outermost portions of opposite ends of the blank in an overlapping relation against the mandrel to form a side seam. The containers are removed from the mandrel with an extractor plate which physically engages the containers upper edge.

35 Claims, 11 Drawing Sheets

METHOD AND APPARATUS FOR FORMING NON-ROUND CONTAINERS

FIELD OF THE INVENTION

The present invention is generally related to the production of containers having a non-round cross section. More particularly, the invention is directed to a machine having an improved capability of forming non-round containers with different heights and cross sectional configurations, with the ability of easily extracting the container from the device once formed and with the ability to form smooth seams.

BACKGROUND OF THE INVENTION

Round and non-round paper containers have achieved considerable popularity for the packaging of a variety of products, especially food products. Conventional practice in the manufacture of non-round paper containers involves wrapping flat paper side wall blanks around mandrels having a desired non-round cross-section and heat sealing edge portions of the blanks together to form an overlapped seam. A bottom disk is then applied and the bottom edge portion of the container body is crimped onto and sealed to the disk. The top edge of the container is usually curled or rolled for strength and for receiving a removable lid.

The machinery that has been developed in the past to carry out these operations has been satisfactory for the most part, however, it has not been wholly free of problems. Existing machines are not able to produce enough containers to meet the 1800 gallon per hour freezer capacity which is common in the ice cream industry. Consequently, it is necessary to use more than one machine to meet the prevailing standard of freezer capacity. Another problem is that the faster machines are expensive and thus disadvantageous for relatively low volume operations where the volume is insufficient to justify the expense. Existing machinery is further characterized by an inability to be adjusted easily to handle containers that vary in shape, diameter and/or height.

The container side wall blank must be wrapped closely around the mandrel or its shape can vary to an unacceptable extent. In the past, wrapping has been carried out in a wholly mechanical fashion, and the side wall blank can exhibit crinkles or other deformities that make the container defective. It has also been difficult to achieve uniform heating of the edge portions of the blanks in order to assure a strong and effective seam on the side wall of the container.

Applicant has proposed a conventional system (U.S. patent application Ser. No. 07/854,319, entitled "Machine and Method For Forming Round Paper Containers" which was filed Mar. 19, 1992 and abandoned on Mar. 11, 1993 incorporated herein by reference) in which flat paper side wall blanks are held on edge in a stack in a magazine. A pusher arrangement holds the front or leading side wall blank in position to be picked up by suction cups which are carried on a rotary turret. When the turret rotates to position a pair of the suction cups in front of the leading blank, the suction cups are extended and suction is applied to them so that the blank is picked off of the stack when the cups are retracted.

The turret then rotates by an incremental arc of 90 degrees, and the suction cups carry the blank along curved rails which maintain the blank in a curved configuration when it stops at a heating station located at the top of the turret. A pair of curved heaters apply heat to the opposite edges of the blank to melt resin with which the paper blank has been treated. The turret is rotated by another 90 degree increment to carry the blank to a wrapping station. At the wrapping station, the suction is relieved on the suction cups and a linear clamp rotatably drives vertical slides along a track to push the blank against a mandrel. Thereafter, separate vertical rods are rotatably driven about a mandrel along an arcuate path to wrap the blank around the mandrel. Vacuum applied to circumferential grooves in the outer surface of the mandrel assures that the blank closely conforms with the mandrel surface before the overlapping edges are sealed by a pressure bar.

The vacuum is applied to the interior of the mandrel and through ports to the vacuum channels or grooves in the mandrel surface. The ports are located on the front of the mandrel which is the part of the mandrel that is first contacted by the blank. Consequently, the ports are immediately covered by the blank and the vacuum force is able to follow the grooves as the blank is progressively wrapped around the mandrel.

Pivotal wrapping wings carry the vertical rods that actually wrap the blank as the wings are pivoted. A unique rack and pinion mechanism causes the wings to travel at different speeds so that the two wings finish their movement at different times. This creates an overlap in the edges of the side wall blank and assures an overlapping seam. The curvature of the blank while it is being heated provides it with a strong, stable shape and assures that the heating takes place uniformly to provide a consistent seam along the height of the container wall. The suction cups in each pair are adjusted in and out to accommodate containers which differ in diameter. The magazine is adjustable up and down to provide the machine with the ability to easily handle containers that vary widely in both diameter and height.

However, even the foregoing system proposed by the applicant experienced certain limitations. In particular, applicant's foregoing system was primarily intended for use with round paper containers having a uniformly curved contour. The round containers also had a large radius with a slightly curved surface upon which the overlapping seam was formed. This system was ill suited for non-round containers.

Heretofore, machines for producing non-round paper containers have experienced at least three primary disadvantages, namely a complex and space consuming mechanism for wrapping the container blank about the non-round mandrel, a complex and expensive mechanism for extracting a completed container from the machine and an inability to produce smooth seams upon non-round containers having a substantially small radius at the seam. For instance, the pivotal wrapping arms of applicant's conventional system were ineffective with multiple container sizes and were unable to cause the blank to conform to the mandrel. As to the extraction mechanism, the conventional systems removed a container from the mandrel by physically grabbing a rim formed about the bottom edge of the container. Once this edge was grasped, the container was pulled downward off of the bottom of the mandrel. However, this process required additional machinery both to form the lower lip and to effect extraction.

Applicant's conventional system eliminated this lower lip and the mechanism necessary to construct and grasp such a lip in a round container application. Applicant's conventional round system utilized the plurality of air grooves about the mandrel to remove the container. Once a container was completed, air was blown outward through these grooves, thereby causing round containers to swell uniformly and to separate from the mandrel to effect self-release. Thereafter, gravity and air caused the container to fall off the bottom of the mandrel. The machine for producing round containers afforded self-release since the containers offered a uniform curvature and thus the expelled air acted uniformly upon the container.

However, air expelled outward through the mandrel does not react uniformly upon a non-round container. Instead, the air focuses upon the substantially flat portions of the container and has little effect upon the more arcuate portions thereof. By focusing air in this manner, the substantially flat portions of the container swell outward, thereby causing the end arcuate portions to pinch against the mandrel and bind. Once these end portions bind, the container will not self-release from the manual. Hence, forced air is ineffective as a means to release non-round containers from the container producing machine.

Moreover, conventional systems have been unsuccessful in forming smooth seams along the adjoining edges of a non-round containers having certain contours. This problem is due substantially to the fact that seams upon non-round containers are typically provided along end portions of the containers having a somewhat small radius of curvature. Wrinkled seams are created along the container ends since, prior to introduction of the side seam clamp, the overlapping edges of the wall blank do not conform to the mandrel at the seam, but instead project outward therefrom (at a tangent to the mandrel) to form a V-shaped intersection with one another.

More specifically, when a non-round container is formed, the mandrel is oriented with its opposite ends having the shorter radius and the sides having the larger radius. In the past, the seam has been formed along one of these ends. Along this line, the conventional machine contacted the forward most portions of the container blank to cause such edge portions to overlap the end of the mandrel. However, the wrapping mechanism in these machines was unable to directly contact the outermost ends of the container blank as it would interfere with the sealing mechanism. The sealing mechanism requires a free zone which could not be interfered with by the wrapping arms. Within this free zone, the outermost ends of the wall blank remain straight and projected tangentially along the mandrel. These tangential portions of the container blank intersect to form the V-shaped bridge which the sealing mechanism attempts to collapse against the mandrel. These outer ends are covered with a hot poly resin and, once heated in the heating station, do not effectively slide against and collapse upon one another to lay flush against the end of the mandrel. Instead, the hot poly resin upon each end sticks to one another prematurely thereby causing a wrinkle at the seam.

It is the object of the present invention to overcome the problems experienced heretofore.

SUMMARY OF THE INVENTION

The present invention is directed to a non-round container forming machine which is improved in several aspects over conventional systems. In particular, the present invention is characterized in its ability to produce containers of different sizes and of different shapes. This advantage is achieved by providing an improved wrapping mechanism useful with a plurality of mandrel sizes and shapes. The present invention is further characterized in its ability to produce a smooth seam upon the container and thereafter easily remove the container from the mandrel, no matter what its shape, by providing improved sealing and extraction mechanisms.

The wrapping mechanism of the instant invention includes a wing slide assembly which moves linearly along opposite sides of the mandrel to fold a wall blank thereagainst. The wing slide assembly includes oppositely opposed wiper plates, the distance between which is adjustable to afford usage with various mandrel sizes, independently of the radius of curvature of the sides of the mandrel.

The wrapping mechanism further includes forward wing clamps which pivotally engage outermost portions of opposite ends of the wall blank once the wiper plates are fully extended. The wing clamps include engaging faces having a concave contour which substantially conforms to the contour of the portion of the mandrel to which the blank is to be pressed against. This pivotal motion enables the basic wing clamp assembly to be utilized with any size and shape mandrel, while simply requiring facing pads to be replaced thereon. Each set of facing pads corresponds to a particular group of mandrel shapes. The forward wing clamp assembly may be constructed to provide an overlapping seam between outer ends of the container at a point along the side of the mandrel. By orienting the seam in this manner, a smooth seam is formed at a point along the mandrel having a radius of curvature substantially greater than that at the rear end of the mandrel.

The present invention further includes a unique extraction assembly which physically grasp each container and pulls it off of the bottom of the mandrel. This extraction mechanism utilizes a horizontally aligned plate with an opening therethrough having a contour which substantially conforms to the outer contour of a container upon the mandrel. Once the container is formed, the mandrel is rotated to the extraction station and the extractor plate is raised vertically about the container. Proximate the top of the container, stripping fingers upon the extractor plate engage the upper edge of the container. Thereafter, the extractor plate is lowered and the stripping fingers pull the container downward off of the mandrel. The extractor plate continues downward into close proximity with a hooking plate which removes the container from the extractor plate. The hooking plate includes hook members on its upper side which extend upward through the opening in the extractor plate to engage the container top. This extraction assembly affords a reliable method for removing non-round containers from the mandrel.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
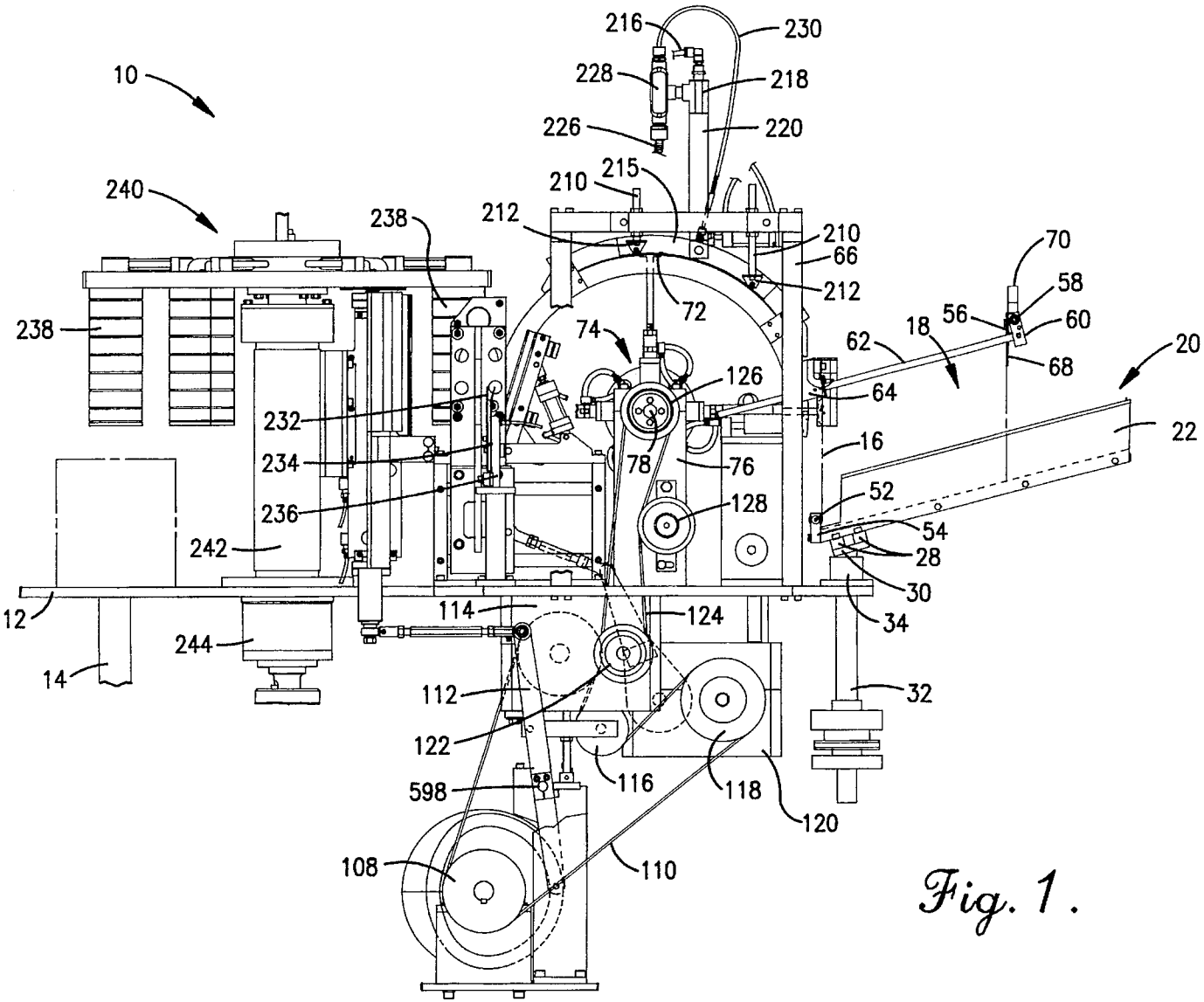
FIG. 1 illustrates a side elevational view of a non-round container forming machine constructed according to a preferred embodiment of the present invention.

Referring now to the drawings in more detail and initially to FIG. 1, numeral 10 generally designates a machine which is used to produce non-round containers. The machine 10 has a rigid frame which includes a horizontal base panel 12 supported on a plurality of legs 14 or other supports. The operating components of the machine 10 are supported on the frame.

Figure 2:
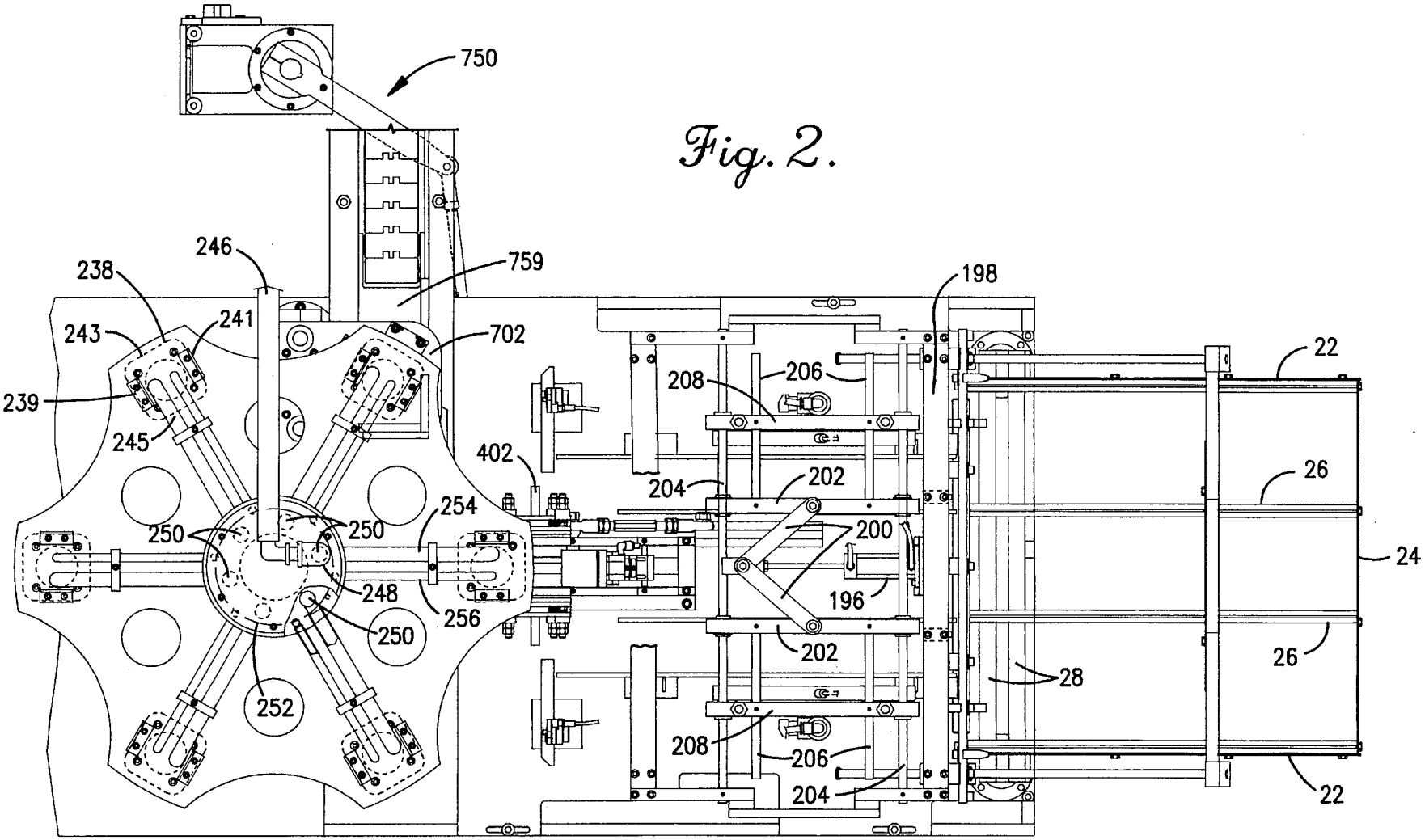
FIG. 2 illustrates a top plan view of the machine shown in FIG. 1.

The machine receives flat side wall blanks 16 which are loaded on edge in a stack 18 on a magazine which is generally identified by numeral 20. The magazine 20, heating station and the infeed turret 74 appear substantially as in applicant's conventional system disclosed in U.S. patent application Ser. No. 07/854,319 incorporated by reference. Thus, the magazine 20 and the turret 74 are only discussed briefly. As best shown in FIG. 2, the magazine 20 includes opposite side walls 22 and a back end wall 24 which extends between the side walls. The bottom of the magazine 20 is formed by spaced apart bars 26 on which the lower edges of the side wall blanks 16 rest in the magazine 20. With reference again to FIG. 1, the magazine 20 is mounted on a pair of bars 28 which are secured to the front edge portion of the magazine and which are connected to one another by an underlying plate 30. The bars 28 are fixedly mounted within indentations in the bottom of the magazine 20 and a rib section of the magazine 20 between the indentations fits between the bars 28. Screws are used to securely join the magazine floor and the bars 28. When the screws are loosened, the magazine may be slid side to side as the bars slide within the indentations. Once the magazine is set at a desired lateral position (as viewed from the end) the screws are tightened to affix the bars 28 within the indentations.

Figure 5:
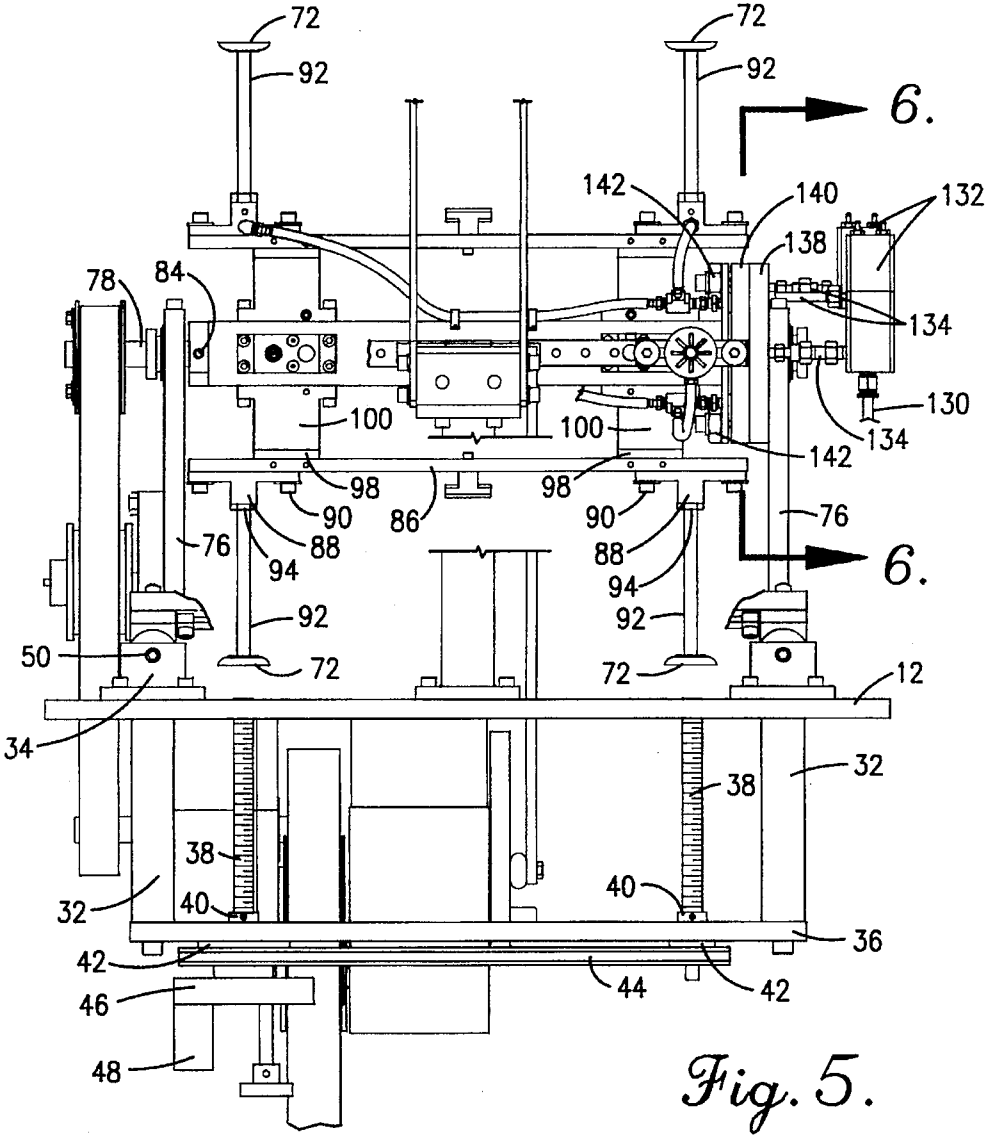
FIG. 5 is a fragmentary end elevational view of the machine taken from the right side of FIG. 1.

The support bars 28 are carried on the top ends of a pair of vertical posts 32 which fit slidably through bearings 34 mounted on top of the base plate 12 near its opposite sides. As best shown in FIG. 5, the lower ends of the post 32 are connected with a plate 36. A pair of vertical screws 38 are threaded to the base plate 12 at their top ends. The screws 38 are supported for rotation by bearings 40 mounted to the bottom plate 36. At a location below the bottom plate 36, each screw 38 carries a sprocket 42. The sprockets 42 are connected by a chain 44. One of the sprockets 42 is connected with a crank 46 having an off center handle 48.

This mounting arrangement of the magazine 20 allows it to be quickly and easily raised and lowered in order to accommodate container side wall blanks that differ in their height. Set screws 50 which secure the posts 32 to the bearings 34 can be loosened, and the crank 40 can then be turned by hand in opposite directions to raise and lower the magazine. When the crank is turned in one direction, both screws 38 are turned in the same direction by reason of the driving connection that is established between the screws by the sprockets 42 and chain 44. When the screws are turned, they are either threaded upwardly through the base plate 12 in order to pull the lower plate 36 upwardly, or they are threaded downwardly to lower the bottom plate 36. The posts 32 move up and down with the lower plate 36 and this adjusts the position of the magazine up or down depending upon the direction the crank is turned. When the magazine has been adjusted to the desired height, the set screws 50 are tightened again to secure the magazine in place.

As best shown in FIG. 1, the magazine is inclined downwardly from right to left such that the side wall blanks in the stack 18 tend to move toward the left or discharge end of the magazine under the influence of gravity. The leading side wall blank 16 in the stack 18 is stopped at the discharge end of the magazine by a roller 52 which extends between a pair of mounting brackets 54 and which contacts the leading side wall blank at a location slightly above its lower edge.

The magazine is equipped with a pusher assembly which assists in urging the stack 18 toward the discharge end of the magazine 20. The pusher assembly includes a pusher bar 56 which is pivotally connected at 58 to a pair of blocks 60 at its opposite ends. A rod 62 extends forwardly from each block 60 through a bushing 64. The bushings 64 are mounted to upright posts 66 which extend upwardly from the base panel 12. The rods 62 incline downwardly from right to left so that the pusher bar 56 tends to move from right to left under the influence of gravity. A pusher plate 68 extends downwardly from the bar 56 and engages the back side wall blank in the stack 18 in order to urge the stack to the left. At the center of the bar 56, a handle 70 is provided. By grasping the handle 70, the bar 56 and plate 68 can be pivoted about the pivot connection 58 so that additional side wall blanks can be loaded into the magazine.

At the discharge end of the magazine 20, the side wall blanks 16 are picked off one at a time by suction cups 72 which are carried on an infeed turret generally identified by numeral 74. The turret 74 is supported on a pair of vertical panels 76 mounted on and extending upwardly from the base plate 12. Opposite ends of the turret 74 include stub shafts 78 (FIG. 5) which are rotatably supported by end panels 76. A turret axle extends between the shafts 78 and is secured to them by set screws 84. The turret axle is thus supported for rotation about the horizontal axis established by the shafts 78.

The suction cups 72 are arranged in pairs, and each pair of suction cups is mounted to rotate with the turret axle. A bar 86 is provided to carry each pair of suction cups 72. A pair of mounting brackets 88 are connected to each bar 86 near its opposite ends by screws 90. Hollow rods 92 are connected with the mounting brackets 88 and secured by nuts 94. One of the suction cups 72 is mounted on the end of each of the rods 92. Each of the bars 86 is provided with a plurality of spaced apart openings for receipt of the screws 90. This permits the suction cups 72 in each pair to be adjusted toward and away from one another by moving the brackets 88 inwardly or outwardly on the bar 86.

In order to extend and retract the suction cups 72 in each pair, each bar 86 is mounted on the turret for movement between a retracted position and an extended position. Each bar 86 normally bears against a pair of pads 98 near its opposite ends. The pads 98 are located on the outer ends of a pair of bearing blocks 100 screwed or otherwise secured to the turret axle 82.

The turret axle 82 is driven rotatively by a drive system which is best shown in FIG. 1. The drive pulley 108 is rotated by a suitable power source such as a motor. A drive belt 110 is drawn around pulley 108 and another pulley 112 which provides the input to an indexer 114 mounted beneath the base plate 12. Belt 110 is also drawn around an idler pulley 116 which may be adjusted up and down to adjust the tension in the belt 110. Finally, belt 110 is drawn around another pulley 118 and back around pulley 108. Pulley 118 drives an oscillator 120 mounted beneath the base panel 12.

The indexer 114 drives an output pulley 122 in preselected rotational increments, at the end of which the pulley 122 is held stationery for a predetermined dwell period. A belt 124 is drawn around pulley 122 and around another pulley 126 which is mounted on one of the shafts 78 connected with the turret axle. An idler pulley 128 also engages belt 124 and may be adjusted to adjust the tension of belt 124.

Figure 3:
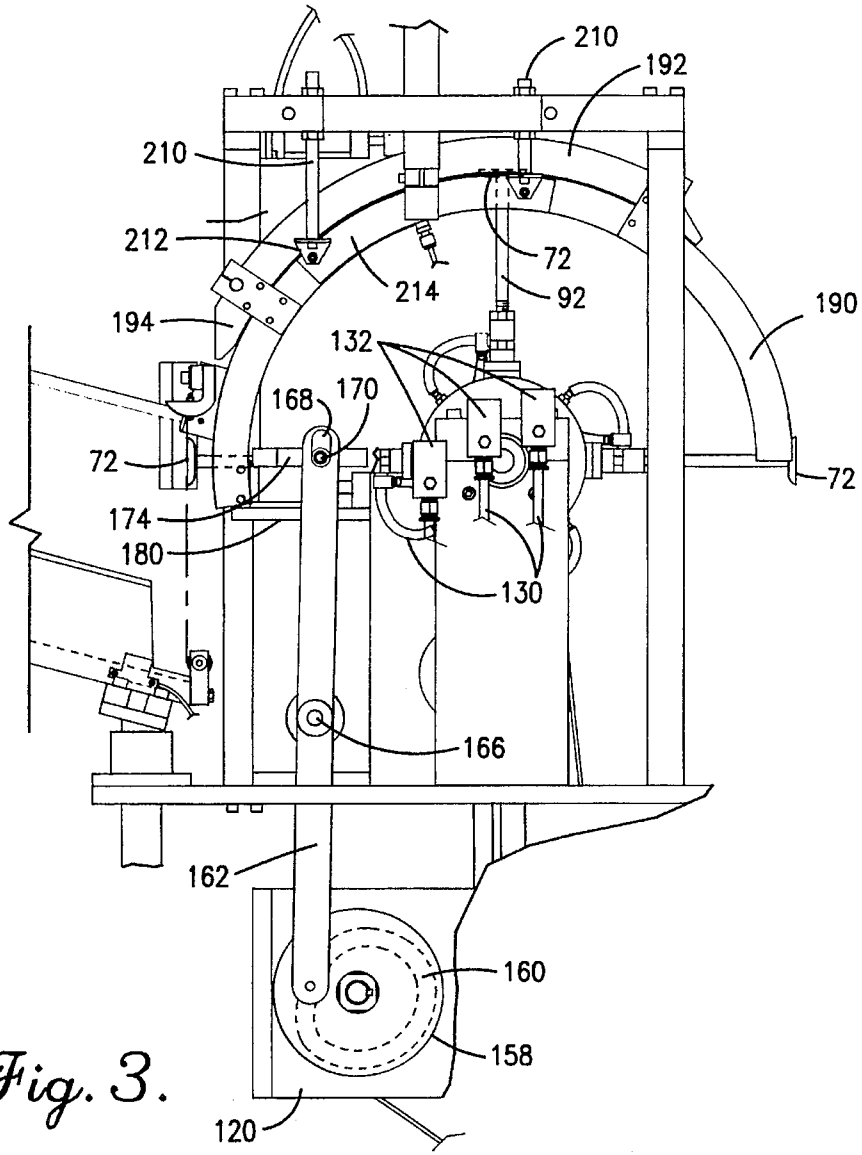
FIG. 3 illustrates a side elevational view of the end feed turret of the machine taken from the side opposite that visible in FIG. 1.

By virtue of this drive system, the infeed turret 74 is driven in successive 90 degree incremental arcs of rotation and is stopped for a preselected dwell period at the end of each rotational arc before the next arc is initiated. The four pairs of suction cups 72 are spaced apart on the turret at 90 degree increments such that during each dwell period, one pair of rods 92 extend to the left, another pair extend to the right, a third pair extend upwardly and the final pair extend downwardly. The suction cups 72 that extend to the left as viewed in FIG. 3 are located at a pickup station for picking off the leading side wall blank 16 in the stack 18. The turret rotates counterclockwise as viewed in FIG. 1. Accordingly, the next increment of rotation carries the suction cups upwardly to a heating station which will be described briefly below. The next increment of rotation carries the suction cups such that they extend to the left from the turret as viewed in FIG. 1, and they are then located at a wrapping station of the machine which will be described in detail below. When the suction cups are directed downwardly after the next rotational increment, they are in an idle position before they are again rotated to the pickup station.

Suction is selectively applied to the suction cups as they are rotated around on the turret 74. As best shown in FIG. 3, three air pressure lines 130 connected with respective vacuum transducers 132 produce vacuum on their output sides. Each transducer 132 has an output line 134 (FIG. 5) connected with ports formed in a stationary disk 138 secured to the inside surface of the frame panel and extending around the stub shaft 78. A rotating disk 140 is urged against the inside surface of disk 138 by a plurality of compression springs within housings 142. The springs maintain close contact between the rotating disk 140 and the stationery disk 138.

Figure 6:
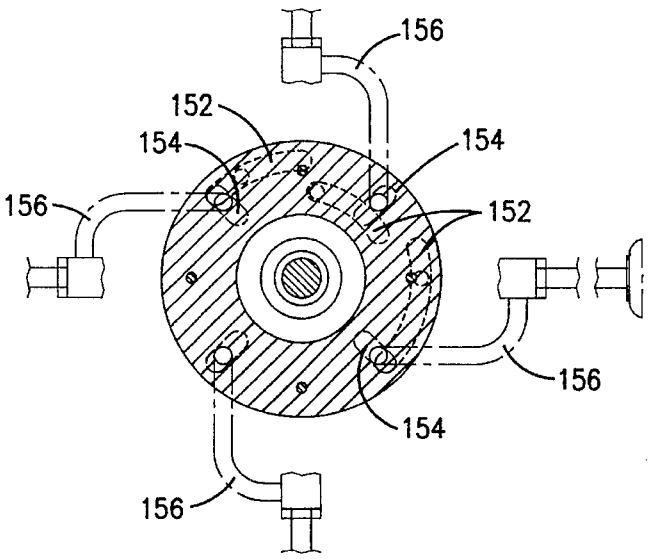
FIG. 6 is a fragmentary sectional view on an enlarged scale taken generally along line 6—6 of FIG. 5 in the direction of the arrows.

As best shown in FIG. 6, the stationery disk 138 is provided with three arcuate vacuum channels 152 which connect with the respective ports. The rotating disk 140 is provided with four radial grooves 154 which are spaced around the disk at 90 degree intervals. Each groove 154 connects with a vacuum line 156. Each vacuum line connects through suitable fittings with the two mounting brackets 88 on the corresponding bar 86. The vacuum is applied through the hollow rods 92 to the suction cups 72 and acts through radial slots in the faces of the suction cups.

The vacuum channels 152 and radial grooves 154 are strategically arranged such that vacuum is applied to each pair of suction cups 72 as soon as it reaches the pickup station adjacent to the magazine 20. At this point, the groove 154 associated with the suction cups comes into registration with one of the arcuate vacuum channels. As the suction cups are rotated away from the pickup station toward the heating station, the groove 154 remains in registration with the channel and then registers with another channel as the suction cups approach the heating station. As the suction cups rotate away from the heating station, the groove remains in registration with the vacuum channel and comes into registration with another vacuum channel as the suction cups approach the wrapping station. Immediately after the suction cups reach the wrapping station, the groove 154 goes out of registration with the vacuum channel, and the vacuum to the suction cups is then relieved. Vacuum remains unavailable to the suction cups as they rotate away from the wrapping station and becomes available again only when the suction cups reach the pickup station.

In this fashion, the porting arrangement for the vacuum system allows the suction cups to receive suction at the pickup station and as they rotate from the pickup station to the wrapping station. Thereafter, vacuum is unavailable to the suction cups until they once again reach the pickup station. This porting arrangement allows the vacuum source to remain constantly on while at the same time making vacuum available only to the suction cups which are handling container side wall blanks.

When each pair of suction cups 72 reaches the pickup station, the suction cups are extended and then retracted to pick off the leading side wall blank from the stack 18 due to the suction which is applied to the suction cups.

As best shown in FIG. 3, the indexer 120 drives a wheel 158 having a cam track 160. A generally vertical lever 162 carries on its lower end a roller which rides in the cam track 160. The lever 162 is pivoted near its center to the frame of the machine at 166. The top end of lever 162 is provided with an elongated vertical slot 168 which receives a pin. The pin 170 (FIG. 4) projects to the side of a plate 172 which is secured to a block 174 provided with internal bushings 176. Extending through the bushings 176 is a generally horizontal rod 178 which is secured to a bracket 180. The bracket 180 is in turn secured between a pair of curved center rails 182 which are mounted on the frame of the machine. The block 174 is able to slide on rod 178 between extended and retracted positions of the suction cups 72.

After the cups 72 have stopped at the pickup station at the start of its dwell period there, wheel 158 reaches a position such that the interaction between the cam roller 162 and the cam track 160 causes lever 162 to pivot about pivot connection 166 from a non-vertical position to the more vertical position shown in FIG. 3. When the suction cups are fully extended, they contact the face of the leading container blank 16. The container blank adheres to the suction cups because of the vacuum that is supplied to them. Continued rotation of wheel 158 causes the lever 162 to pivot back, thus sliding block 174 to the left as viewed in FIG. 4 and retracting the suction cups to the retracted position before the dwell period at the pick up station has expired. In this manner, the container blanks 16 are picked off one at a time from the stack by the successive pairs of suction cups that are rotated to the pickup station.

As the turret 74 rotates to carry the container blank 16 on suction cups 72 from the pickup station to the heating station, the curved rails 192 cooperate with another pair of rails 190 to cause the container blank to assume a curved configuration. The rails 190 and 192 are suitably secured to the frame of the machine and are located such that the opposite side edge portions of the container blank extend between the sets of rails 190 and 192. As the container blank is rotated away from the pickup station, its upper edge is received beneath a tapered nose 194 (see FIG. 3) of rails 192. As the rotation of the turret progresses, the container blank is captured between the closely spaced rails 190 and 192 and is bowed or curved in conformity with the curvature of the rails when it reaches the heating station at which the rods 92 extend straight upwardly. The container blank also contacts the lower curved edges of rails 182 which thereby assist in achieving a curved configuration of each container blank when it is at the heating station.

The container blanks 16 may be treated with plastic extrusion resin which melts when subjected to suitable heat. At the heating station, the opposite side edges of the container blank are heated to effect melting of the resin so that the edges can subsequently be sealed together at the wrapping station. As best shown in FIG. 2, a power cylinder 196 is mounted on a cross bar 198 extending across the top of the frame of the machine. The rod end of cylinder 196 is pivoted to a pair of links 200 which are pivotally connected at their opposite ends to a pair of brackets 202 mounted for sliding movement on rods 204 which extend between opposite sides of the frame of the machine. A pair of adjustment rods 206 extend outwardly from each bracket 202. Another bracket 208 is connected with each pair of the rods 206. The brackets 208 serve as mounting brackets for the heaters which melt the resin on the container blanks.

As best shown in FIG. 1, threaded through each of the heater mounting brackets 208 is a pair of rods 210. The lower ends of rods 210 carry mounting brackets 212 to which a curved, hollow heater bar or manifold 214 is mounted (FIG. 3). Each of the heater manifolds 214 is curved in conformity with the curvature of the container blank at the heater station. Air is supplied to each of the heaters through an air tube 216 (see FIG. 1). A suitable source of air under pressure supplies air to the tube 216. The tube 216 connects through a fitting 218 with a hollow housing 220 which contains an electrically heated coil (not shown). The housing 220 is secured at its lower end to an elbow which in turn connects with the heater bar or manifold 214. Each of the heater manifolds is provided with a plurality of openings through which the heated air passes and is applied to the container blank for melting of the resin.

Figure 4:
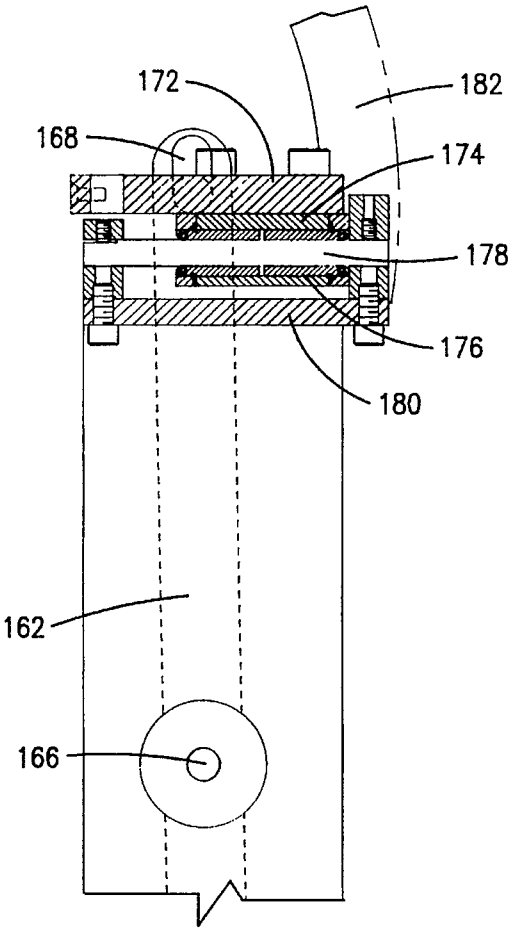
FIG. 4 is a side elevational view of the extraction mechanism of FIG. 1.

As can best be seen by comparing FIGS. 1 and 3, the heater manifold on one side of the machine is located above the container blank (the manifold 215 shown in FIG. 1), while the manifold on the other side of the machine is located below the container blank (the manifold 214 shown in FIG. 4). Consequently, the blank is heated on its top surface along one of its side edges and on its under surface along the other side edge. The manifold 214 which heats the top surface of the container blank has the outlet openings in the bottom side of the manifold 214, while the manifold which heats the underside of the container blank has its openings in the top of the manifold. Heating of the opposite surfaces of the container blank along opposite edges permits an effective overlapping seam to be established, as will be explained more fully. It is also noted that the rods 210 may be threaded up or down relative to the heater mounting brackets 208 in order to adjust the manifolds 214 up or down as desired.

Electrical power for energizing the heating coil within the housing 220 is provided by wiring which extends through a conduit 226 which connects with a T-fitting 228. Each heating unit is also provided with a thermocouple 230 which senses the heat at the heating manifolds 214 and 215 and connects back with the fitting 228.

In the event that a container blank becomes jammed in the machine or if another malfunction should occur which causes the container blank to be held at the heating station for a prolonged time, the malfunction is sensed by the machine, and the cylinder 196 is retracted from the normally extended position shown in FIG. 2 to a retracted position (not shown). In the FIG. 2 position, the heating units are located to heat the edge portions of the container blank. However, when the cylinder 196 is retracted, the links 200 pivot in an oblique direction to push the brackets 202 outwardly, and the connection provided by the adjustment rods 206 causes the heater mounting brackets 208 to also be pushed outwardly. This displaces the heaters well outwardly from the edges of the side wall blanks in order to avoid overheating of the paper and possible fire.

After the dwell period at the heating station has expired, the turret is rotated an additional increment of 90 degrees to carry the container blank to the wrapping station. As best shown in FIG. 1, the leading edge of the container blank is received at the wrapping station between pairs of thin guide fingers 232 (FIG. 1) which project upwardly from a plate 234. The guide fingers 232 are provided on the opposite side edges of the plate 234 and thus receive the edge portions of the side wall blank. The plate 234 is secured to a panel 236 which is suitably mounted to the frame of the machine at the wrapping station. The guide fingers 232 assist in guiding the container blank to the proper position at the wrapping station.

At the wrapping station, each container blank 16 is wrapped around a generally non-cylindrical mandrel 238 which is carried on a rotary mandrel turret generally identified by numeral 240. The mandrel turret 240 carries any number of the mandrels 238 which are spaced apart evenly (for instance, six mandrels may be provided at 60 degree increments) on the mandrel turret (see FIG. 2). As illustrated in FIG. 2, non-cylindrical mandrels 238 exhibit a substantially rectangular shaped cross-section with curved corners connecting sides sections 239 and 241 and end sections 243 and 245. Each mandrel 238 is oriented such that the side sections 239 and 241 face in opposite directions and substantially perpendicular to the direction of movement of the wrapping assembly. A front end section 243 of each mandrel faces the infeed turret 74, while a back end section 245 faces the mandrel turret 240. As best shown in FIG. 1, the mandrel turret 240 is supported on a vertical column 242 and is driven rotatably about a vertical axis by a suitable drive mechanism 244. The drive mechanism indexes the mandrel such that it is rotated at preset (60 degree) increments of rotation and then stopped for a dwell time sufficient for the mandrel to be wrapped with a container blank prior to the initiation of the next rotational increment.

Wrapping of the mandrels is assisted by vacuum which is applied from a suitable vacuum source to a vacuum line 246, as best shown in FIG. 2. The vacuum line 246 connects through an elbow fitting 248 with ports 250 provided in a top plate 252 of the mandrel turret. The ports 250 are connected with vacuum lines 254 and 256. Fitting 248 is located to provide vacuum only to the port 250 for the vacuum line 254 of the mandrel located at the wrapping station. The smaller vacuum line 256 for each mandrel is for use in the application of the bottom of the container, and it receives vacuum through the porting arrangement only as required for holding the bottom in place prior to its being secured to the container side wall blank.

Figure 9:
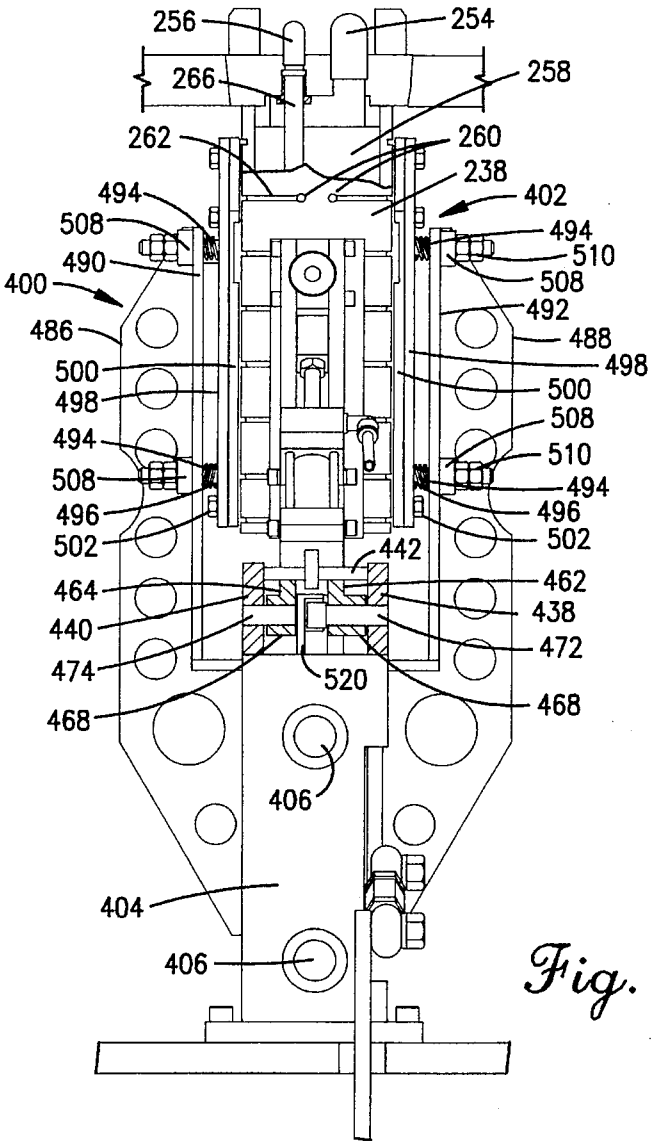
FIG. 9 is an end elevational view of the wrapping assembly of the invention of FIG. 1.

As best shown in FIG. 9, each mandrel 238 has a hollow interior which serves as a vacuum chamber 258. The larger vacuum line 254 connects with the vacuum chamber through the top of the mandrel. A plurality of sets of vacuum ports 260 extend through the wall of each mandrel 238. It is important that the ports 260 are located in the front side of the mandrel which faces toward the container blank at the wrapping station of the machine. Preferably, there are two sets of ports 260 which are arranged in two straight rows extending vertically on the face of the mandrel. Extending from each of the ports 260 is a vacuum channel or groove 262 in the outer surface of the mandrel. Each of the grooves 262 has a terminal end which is almost diametrically opposite from the port 260. The terminal ends of aligned grooves are spaced apart from one another so that a non-grooved face of the mandrel proximate the seam is presented diametrically opposite the ports 260.

The smaller vacuum line 256 for each mandrel connects with a vertical pipe 266 which extends through the vacuum chamber 258 and connects with a small chamber proximate the bottom of the mandrel, isolated from chamber 258 and located to apply vacuum to the bottom surface of the mandrel 238.

Figure 12:
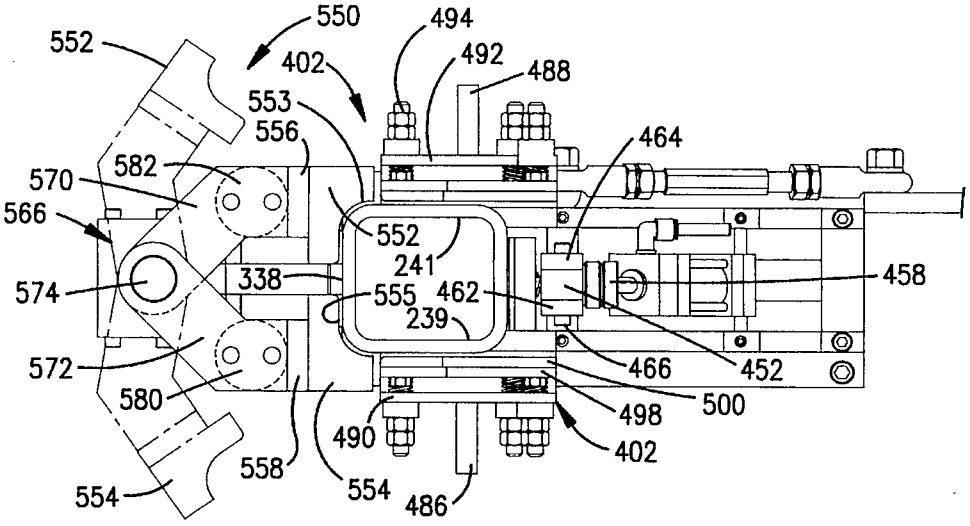
FIG. 12 is a top planar view of the wrapping assembly while in an extended position.

FIGS. 7–10 illustrate a wing slide assembly 400 within the wrapping station which wraps the wall blank/container about the mandrel 238. The wing slide assembly 400 includes a pair of wiper plates 402 (FIG. 9) aligned parallel to and in facing relation with one another. Each wiper plate 402 is oriented along a length of, and is positioned upon an opposite side of the mandrel 238. The wiper plates 402 move linearly along opposite sides of the mandrel 238 to an extended position (as illustrated in FIG. 12). As the wiper plates 402 extend, leading edges and inner faces thereof contact a wall blank to effect a wrapping operation. Looking to FIG. 10, the wiper plates 402 are mounted upon and project vertically upward from a base block 404 having upper and lower bored holes therethrough. Each bore hole receives linear bearings 406 which reciprocally slide along upper and lower support shafts 408. Opposite ends of the support shafts 408 are securely mounted within leading and trailing wing housings 410 and 412. Set screws 418 securely retain opposite ends of the support shafts 408. The leading and trailing houses 410 and 412 are securely mounted upon a wing base 414 which is bolted to the base panel 12.

Figure 8:
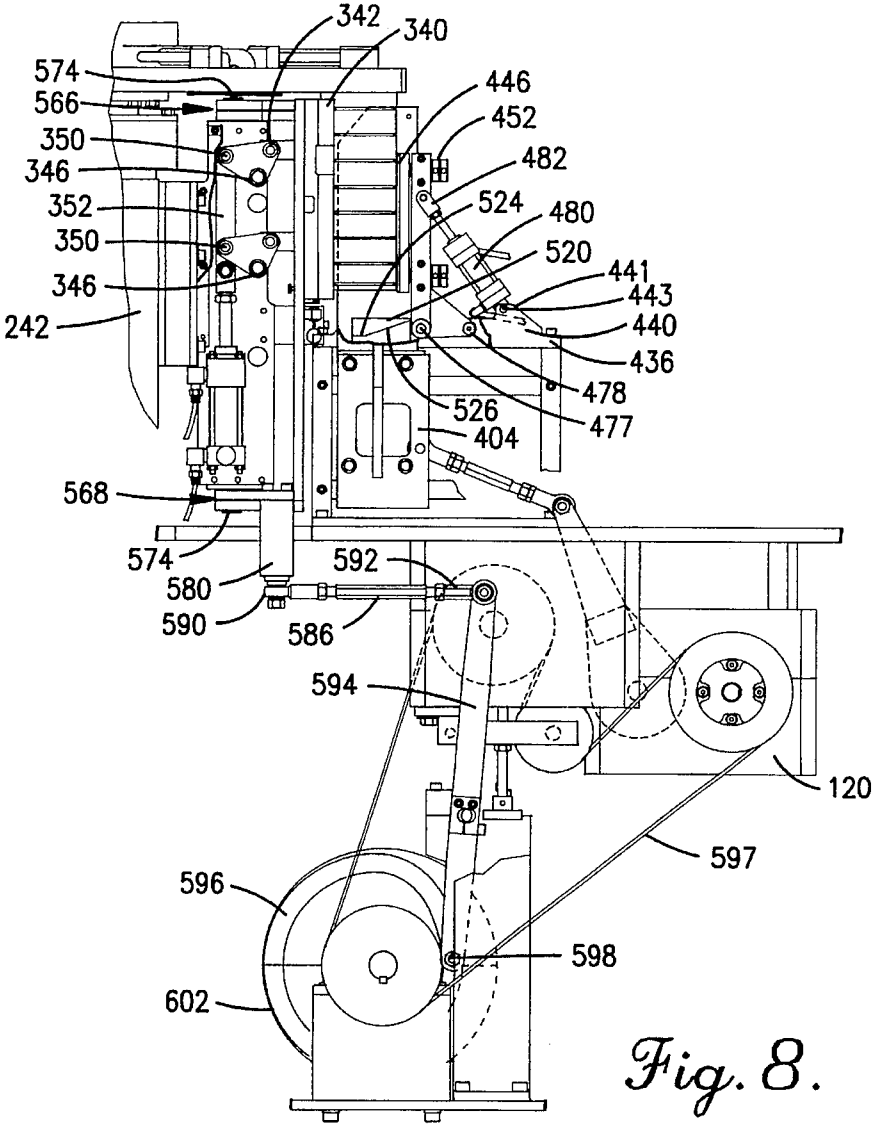
FIG. 8 is a fragmentary side elevational view of the wrapping station while in an extended position.
Figure 7:
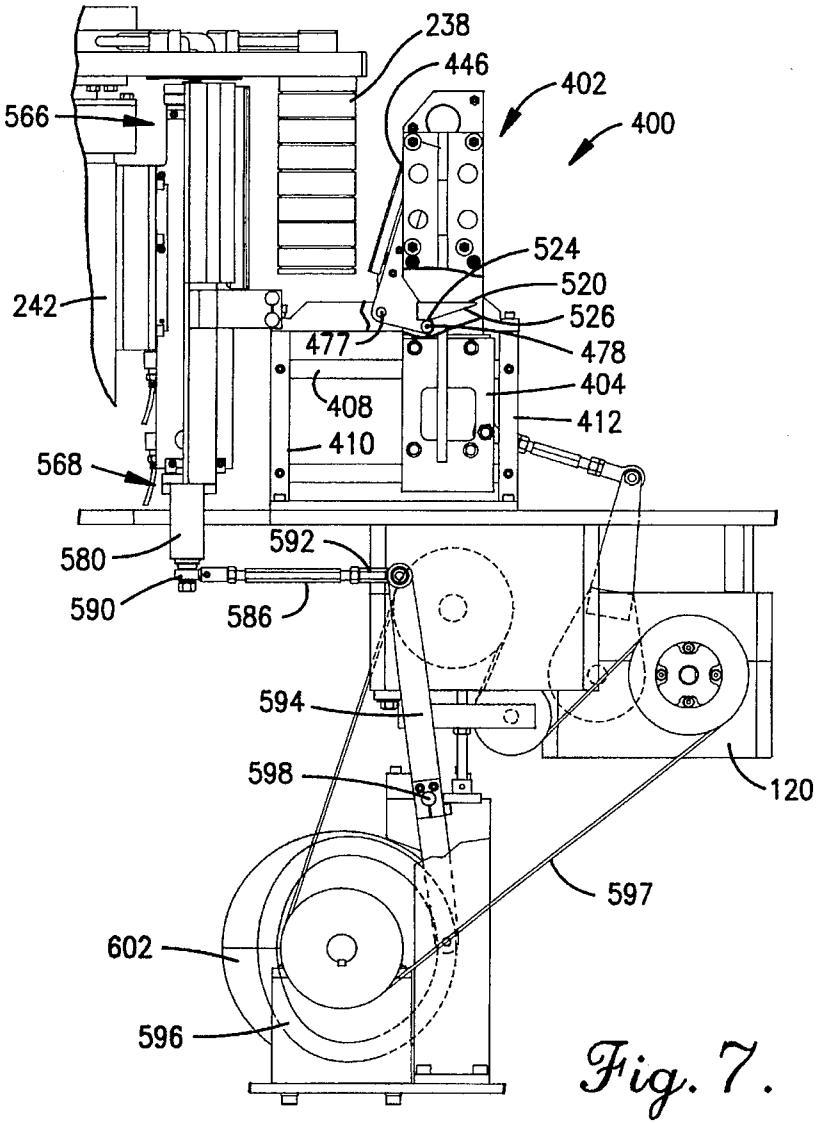
FIG. 7 is a fragmentary side elevational view of the wrapping station while in a retracted position.

The base block 404 (FIG. 10) includes a trailing end which is pivotally fastened to a driving rod 420 via a support shaft 422. An opposite end of the driving rod 420 is pivotally fastened to a driving lever 424. The wiper driving lever 424 includes a lower end pivotally mounted to the oscillator 120. The driving lever 424 pivots about its central axis to move the driving lever 424 in a reciprocating motion thereby forcing the driving rod 420 along a left-right motion. The wheel 430 is driven in an intermittent manner which causes the lever 424 to pivot from a position as illustrated in FIG. 8 (at which the wiper plates 402 are in an extended position) to a position at which the wiper plates 402 are in a retracted position (FIG. 7). The driving rod 420 is adjustable in length at hex nuts 432 and 434.

Upper ends of the leading and trailing housings 410 and 412 supportably receive a clamp foundation 436. The clamp foundation 436 includes opposed side walls 438 and 440 (FIG. 9) which pivotally support, via pin 442 (FIG. 10), the front clamp generally designated by the reference numeral 444.

Referring to FIG. 9, the wiper plates 402 include opposed support extensions 486 and 488, each having a lower end securely mounted to opposite sides of the slide block 404 and projecting upward along opposite sides of the front clamp assembly 444. Upper portions of the support extensions 486 and 488 are constructed with a T-shaped cross-section (see FIG. 12) to afford strength. This T-shaped cross-section provides support flanges 490 and 492 aligned in facing relation to the front clamp assembly 444. The support flanges include holes therethrough located at upper and intermediate points therealong. Each hole receives a corresponding spring and plunger assembly 494. Innermost ends of the plungers 496 are secured to opposed spring plates 498 having a substantially rectangular shape and aligned on edge with a transverse axis through its width running substantially parallel to the direction of movement of the wing slide assembly 400. Inner sides of the spring plates 498 receive push plates 500 secured thereto via counter sunken bolts 502. The push plates 500 engage the wall blanks during operation, thereby directing the wall blank along opposite sides of the mandrel. The push plates 500 are constructed of a material sufficiently soft to avoid tearing of the wall blanks.

The spring and plunger assemblies 494 and 496 are received within recesses in the housings 508 integrally formed with the support flanges proximate the holes therethrough. Nuts 510 are threadably received upon the plungers 496 to adjust a tension thereof and to adjust the distance between the pusher plates 500.

Figure 10:
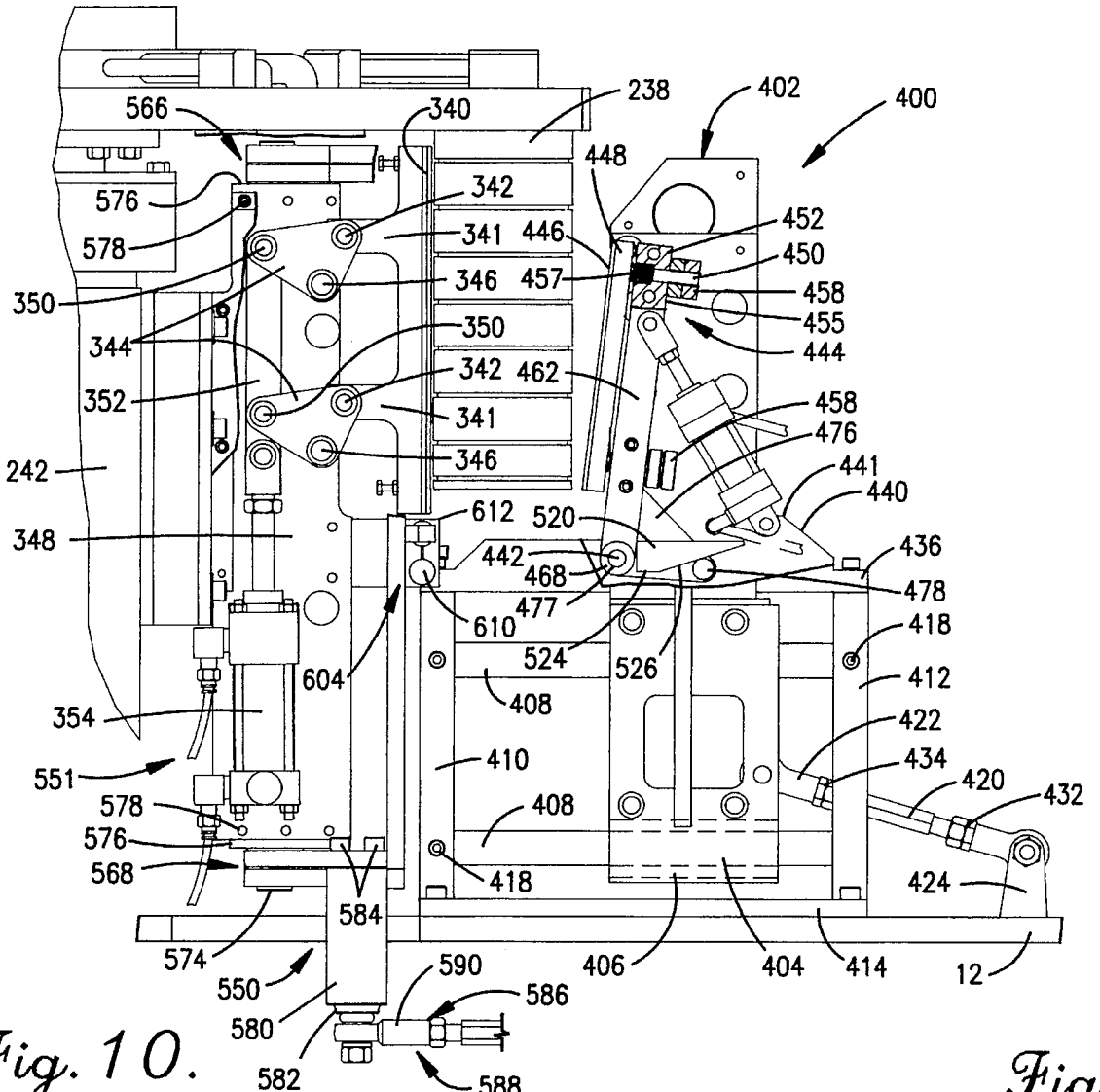
FIG. 10 is a side elevational view of the clamping assembly and the side seam clamp assembly.

At the wrapping station, a portion of the container blank intermediate its edges is initially applied to the mandrel and clamped against it by a front clamping assembly 444 which is best illustrated in FIGS. 7, 8 and 10. The front clamp assembly 444 includes a facing pad 446 which is securely mounted upon the face of a front support 448. Upper and lower ends of the front support 448 receive plungers 450 which are threadably mounted to the back surface thereof. The plungers 450 extend outward perpendicular to the back surface of the front support 448 and project through upper and lower spring housings 452. Recesses 455 within the spring housings receive compression springs 457 which admit the plungers 450 through a center thereof. The compression springs 457 afford an outwardly biasing force against the front support 448 and allow movement thereof when the front clamp assembly 444 is pivoted to an engaging position at which the facing pad 446 pinches a side wall blank against the front end of the mandrel 238. Rearmost ends of the plungers 450 receive hex nuts 458 which prevent the plungers from being forced out of the housings when the facing pad 446 disengages the wall blank. An amount of compression within the springs 456 is adjusted by repositioning the hex nuts 458 along the plungers 450.

The spring housings 452 are sandwiched between left and right side rails 462 and 464 (FIG. 12). Set screws 466 secure the left and right side rails 462 and 464 to the spring housings. The lowermost ends of the left and right rails 462 and 464 include flanges 468 (FIG. 9) integrally formed therewith and projecting outward in opposite directions. The flanges 468 include bore holes therethrough which receive pivot pins 472 and 474. Outermost ends of the pivot pins are received within corresponding holes in side support rails 438 and 440. The pivot pins 472 and 474 allow the front clamp assembly 444 to pivot relative to the side support rails 438 and 440.

A lower section of at least one of the left and right side rails 462 and 464 is formed proximate the flanges 468 and 470, to include a triangular timing control arm 476 (FIG. 10) projecting behind the flange. The control arm 476 extends upward to a point below the lower spring housing 452. The control arm 476 includes a cam follower 478 at a point behind and remote from the pivot point 477. The cam follower includes a roller bearing constructed to roll along a cam mechanism 520. The cam mechanism 520 (FIG. 8) is rectangular in shape and mounted upon the slide block 404 to pass between lowermost ends of the slide rails 462 and 464. The cam mechanism 520 includes a beveled out ledge section along one side thereof defining a path, along which the cam follower 478 travels. This ledge section includes (FIGS. 7, 8 and 10) a starting section 524 proximate its front end which is substantially flat. The starting section 524 adjoins a rising section 526 having a camming surface which is sloped upward to the top back of the cam member 520 at approximately a 30° angle. The starting and rising sections 524 and 526 define the maximum allowable upward movement of the cam follower 478 as the slide block 404 is moved from a retracted to an extended position.

The cam mechanism 520 and cam follower 478 afford a mechanical device which establishes a desired timing between the movement of the clamp assembly 444 and the wing slide assembly 400.

The side support walls 438 and 440 include opposed header ridges 441 (FIG. 8) located at the rearward ends thereof. The header ridges 441 pivotally support, via a mounting shaft 443, an air cylinder 480. A piston 482 within the air cylinder 480 is pivotally mounted to the left and right side rails 462 and 464 proximate the upper spring housing 452. The air cylinder 480 includes inlet and outlet air lines which drive the air cylinder. When the air cylinder 480 is energized it exerts a driving force upon the front clamp assembly 444 thereby attempting to pivot the clamp 44 about point 477. However, in order for the front clamp assembly 444 to pivot forward, the cam follower 478 must move upward along an arcuate path (see arrow A in FIG. 8). This arcuate movement is prevented so long as the slide block 404 is retracted and the cam follower 478 is retained within the starting region 524 of the cam mechanism 520 (see FIG. 7). As the drive rod 420 moves the slide block 404 forward (from the position in FIG. 7 to that in FIG. 8), the cam mechanism 520 affixed thereto moves laterally with respect to the cam follower 478. This lateral motion aligns the cam follower 478 with the rising section 526. The force from the cylinder 480 causes the cam follower 478 to move upward and maintain contact with the rising section 526, thereby allowing the cam assembly 444 to rotate forward. The assembly 444 rotates about the pivot pins 472 and 474 until the facing pad 446 engage the wall blank and compresses it against the front end of the mandrel 238. The springs 457 and plungers 450 afford slight movement between the facing pad 446 and spring housings 452 and 454 to prevent excessive wear thereof and to afford a larger operating range for the air cylinder 480. Adjusting the compression within the springs 456 and the pressure of the cylinder 480 also adjusts the force exerted by the facing pad 446 upon the container wall blanks.

When in operation, a container blank is indexed to the wrapping station and positioned in a substantially tangential alignment with the mandrel 238. As the container blank is so aligned, the air cylinder 480 exerts a driving force upon the front clamp assembly 444 which is held in a retracted position (FIG. 10) by the cam mechanism 520. Once the container blank is properly aligned, the driving rod 420 forces the slide block 404 forward (in a right to left motion in FIG. 8). Thus, the cam mechanism 520 moves away from the cam follower 478 allowing the same to graduate upward along the rising section 526 and the clamp assembly 444 to pivot forward. The air cylinder 480 extends until the facing pad 446 securely engages the wall blank, thereby sandwiching it between the front clamp assembly 444 and the mandrel 238. The air cylinder 480 maintains its extended position, such that the compression springs 457 maintain a predetermined amount of resistance upon the facing pad 446, thereby maintaining a predetermined friction engaging force upon the wall blank. This engagement occurs prior to contact with the plates 402.

The drive rod 420 continues to move the slide block 404, and hence, the wiper plates 402 forward along opposite sides of the mandrel 238. The wiper plates 402 move in close proximity to opposite sides of the mandrel 238 (FIG. 12), such that the pusher plates 500 cause the wall blank to fold along opposite sides of the mandrel. As the wrapping mechanism mechanically wraps the container side wall blank around the mandrel 238, the vacuum which is applied to the mandrel provides assistance in the wrapping operation and assures that the blank will closely conform with the cylindrical outer surface of the mandrel. Because the vacuum ports 260 of the mandrel face the container blank at the beginning of the wrapping operation, the action of the clamp 444 presses the center portion of the blank against the mandrel at a location to cover the vacuum ports 260. The container blank is wrapped progressively away from the ports as the wrapping operation proceeds, and the fact that the ports 260 are initially covered by the container blank allows the vacuum to follow the vacuum channels 260 away from the ports as the wrapping progresses. Consequently, the vacuum is able to draw the container blank closely against the mandrel surface around the entirety of the mandrel, thus assuring that the container blank will closely conform with the mandrel surface without creating wrinkles or other defects.

The wiper plates 402 extend to substantially enclose side portions 239 and 241 of the mandrel 238 (as illustrated in FIG. 12). Once the wiper plates 402 are completely extended, the forward wing clamp assembly (generally designated by the reference numeral 550 in FIG. 12) engages the outermost ends of the container blank and wraps these ends about the rear end of the mandrel 238.

Figure 11:
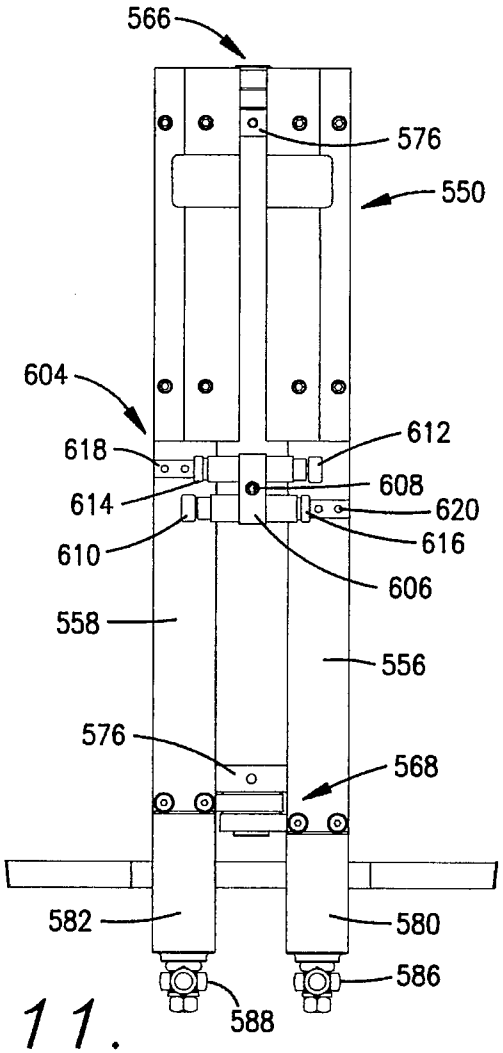
FIG. 11 is an end elevational view as viewed from the left side of FIG. 1 of the forward wing clamp assembly.

As best illustrated in FIGS. 10–12, the forward wing clamp assembly 550 is pivotally mounted upon the side seam clamp assembly 551 (FIG. 10) and is located between the rear end of the mandrel 238 and the infeed turret 242. The forward wing clamp assembly 550 includes a pair of wing pads 552 and 554 (FIG. 12) which engage the outermost end portions of a container blank projecting along opposite sides of the mandrel 238. The wing pads 552 and 554 move along an arcuate path to bend the outer ends of the container blank around the rearmost corners of the mandrel 238 until the seam sections along the outer edges of the container blanks are aligned in an overlapping relation and positioned against the rear wall of the mandrel 238. The wing pads 552 and 554 are securely mounted to front faces of wing bars 556 and 558, respectively. The wing pads are secured to wing bars via threaded nuts counter sunken within recesses in the face of the wing pads 552 and 554. The wing pads 552 and 554 are constructed with a generally rectangular cross-section (as viewed in FIG. 12) with one corner thereof removed to provide an inner arcuate contour along surfaces 553 and 555 substantially following the outer contour of the rear corners of the mandrel 238. The arcuate surfaces 553 and 555 cause the container blank to substantially conform to the contour of the mandrel 238.

The wing bars 556 and 558 are securely fastened, via counter sunken screws, to forwardmost ends of upper and lower wing arm pairs 566 and 568. The upper and lower wing arm pairs 566 and 568 (FIG. 10) each include left and right wing arms 570 and 572 (FIG. 12). Each wing arm is constructed in a boomerang shape with short and long portions integrally formed together at an obtuse angle. Each wing arm 570 and 572 includes a rear end which is pivotally mounted upon a hinge pin 574. Each hinge pin 574 includes an outer end which receives the wing arms 570 and 572 and an inner end which is fixedly mounted to an end cap 576. The end caps 576 are secured via set screws 578 to top and bottom ends of the side seam clamp frame. The upper and lower arm pairs 566 and 568 rotate about the hinge pins 574 in a scissor-like motion (as illustrated by the dash lines in FIG. 12).

As illustrated in FIGS. 10 and 11, the lower wing arm pair 568 includes left and right connecting rods 580 and 582 securely mounted to the lower sides of corresponding left and right wing arms 570 and 572, via bolts 584 (FIG. 10), and proximate the short member portion the front of each wing arm (as illustrated by the dashed circular lines in FIG. 12). Lower ends of the connecting rods 580 and 582 are pivotally secured to drive rods 586 and 588, respectively. The drive rods 586 and 588 intermittently reciprocate along a substantially linear path between extended and retracted positions to effect pivotal movement of the upper and lower wing arm pairs 566 and 568. By moving the wing arm pairs in this manner, the drive rods 566 and 568 cause movement of the wing pads 552 and 554 between expanded and contracted positions (as illustrated in solid and dash lines in FIG. 12).

The drive rods 586 and 588, each comprise opposed end caps 590 and 592 (FIG. 7) having eyes therethrough to be pivotally secured via bolts to the connecting rods 580 and 582 and a pair of drive levers 594 (which are structurally identical, only one of which is illustrated). The end caps 590 and 592 are threadably secured to one another to enable the drive rods to be adjusted in length. The drive levers 594 are pivotally mounted at an intermediate point to pivot pins 598. The lower ends of the drive levers 594 are slidably mounted within tracks 596 of cam wheels 602 which are driven by a belt 597.

As best illustrated in FIGS. 10 and 11, a shock absorber assembly 604 is mounted upon the side seam clamp frame 348 below the pressure bar 340 and between the side bars 556 and 558. The shock absorber assembly 604 includes a mounting bracket 606 which is secured to the side seam clamp frame 348 via a bolt 608. The mounting bracket 606 include recesses therethrough which receive tubular shock absorbers 610 and 612. Each shock absorber 610 and 612 includes a padded plunger 614 and 616. The padded plungers 614 and 616 are aligned to receive cushion blocks 618 and 620 mounted upon and extending forward from the wing bars 556 and 558, respectively. During operation, as the drive levers 594 pivot in a clockwise direction (as illustrated in FIGS. 7 and 8), the levers 594 pull the connecting rods 580 and 582 forward, thereby causing the upper and lower wing arm pairs 566 and 568 to contract in a scissor-like manner. This motion causes the wing pads 552 and 554 to engage the outer ends of the container blank and to fold these ends about the rearward corners of the mandrel 238 in an overlapping fashion. The tracks 600 upon the cam wheels 602 are slightly offset with respect to one another, to stagger the movement of the left and right wing arms, thereby staggering the folding action of the outer edges of the wall blank effected by the wing pads 552 and 554. This staggered motion provides the desired overlap. As the wing pads 552 and 554 reach a contracted or closed position, the cushion blocks 618 and 620 engage the plungers 614 and 616, respectively, to halt the inward movement of the wing pads. Thus, the padded plungers and cushion blocks 614–620 interact to enable the use of a less precise driving mechanism and to prevent jarring contact between the mandrel 238 and the forward wing clamp assembly 550.

Once the side and forward wing clamps have folded a wall blank about the mandrel 238, the side seam clamp seals the overlapping rear ends thereof (FIG. 10). The side seam clamp includes a pressure bar 340 that is pressed against the seam 338 (FIG. 12) to assure that the heat and pressure will provide an effective seal at the seam. The pressure bar 340 has a pair of projecting lugs 341 (FIG. 10) which are pivoted at 342 to a pair of triangular links 344. The links 344 are also pivoted at 346 to a stationery bracket 348 secured to the frame of the machine. The third corner of each link 344 is pivoted at 350 to a bracket 352 mounted on the rod of a pneumatic cylinder 354. When cylinder 354 is in the retracted condition, the linkage which carries bar 340 causes the bar to be withdrawn from the mandrel 238. However, when the cylinder is extended, the linkage presses the bar 340 against the mandrel 238 in order to apply pressure to the seam 338.

After the overlapping seam 338 has been formed, the pressure bar 340 is pressed against it to assure that the seam is effectively sealed along its entire length. After the pressure bar 340 has been withdrawn, the wrapping operation has been completed and the container side wall is formed.

The mandrel turret is then indexed to the next position, and a bottom disk may be applied to the bottom of the container and held temporarily in place by the vacuum applied to the vacuum chamber 268 at the bottom of the mandrel. The mandrel turret may then be indexed to the next station at which heat is applied to the periphery of the disk and the adjacent side wall of the container. The container may then be indexed to the next station at which the lower edge of the side wall is crimped onto the bottom disk to secure the bottom of the container in place. The container may then be indexed to the next station and discharged from the mandrel by an extraction mechanism.

FIGS. 13–17 generally illustrate the extraction station and the extraction assembly generally designated by the reference numeral 700. The extraction assembly 700 includes an extraction plate 702 which is fixedly attached to upper ends of a pair of extractor shafts 704. Specifically, the extractor plate 702 is constructed with a substantially rectangular (FIG. 18) shape having the innermost or rear corners with holes 703 therethrough. Each hole 703 receives a linear bearing 705 through which a corresponding extractor shaft 704 slides. A plate clamp 708 (FIG. 15) is securely fastened, via bolts 709, to the lower side of the extractor plate 702 proximate the rear end thereof. The plate clamp 708 includes front and back halves 710 and 712 each of which has two half moon shaped recesses therein, with corresponding recesses cooperating to form clamping holes through the plate clamp 708 when its halves are joined. Bolts 714 align and draw the front and back halves 710 and 712 of the plate clamp 708 toward one another, thereby reducing the diameter of the clamping holes until mounted at a desired point along the extractor shafts 704.

Figure 18:
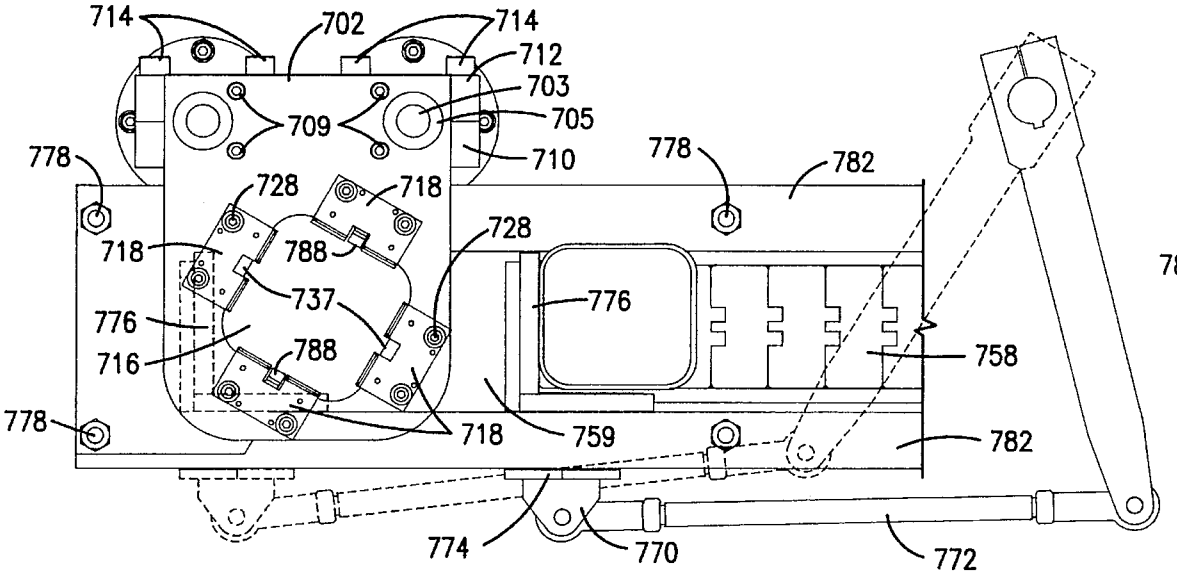
FIG. 18 is a top planar view of the extraction mechanism.
Figure 21:
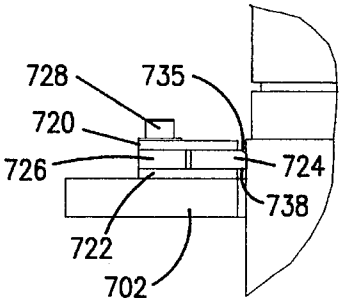
FIG. 21 is a fragmentary side view of a stripping finger along side a container.
Figure 20:
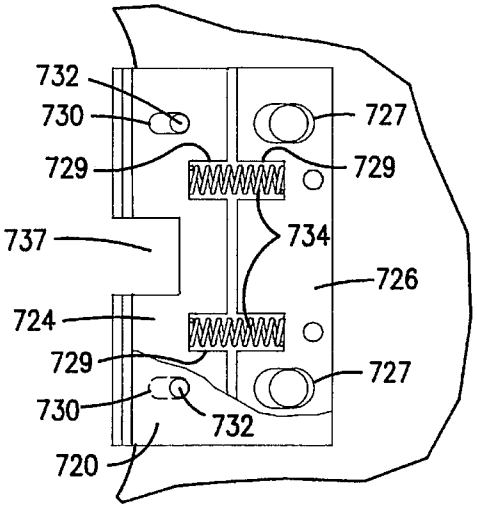
FIG. 20 is a fragmentary top planar view of a stripping finger from the extraction mechanism.

As best illustrated in FIG. 18, the extractor plate 702 includes a container receiving opening 716 therethrough remote from the extractor shafts 704 and having an inner contour which substantially conforms to the outer contour of the mandrel 238. The opening 716 is dimensioned such that the mandrel 238 and a container blank wrapped thereabout are received with the opening 716 with a close tolerance. A plurality of stripping fingers 718 are provided about the periphery of the opening 716. Each stripping finger 718 (FIGS. 20 and 21) is constructed with upper and lower slide plates 720 and 722 with a front stripping bar 724 and a stripping spacer 726 sandwiched therebetween. The stripping bar and spacer 724 and 726 are equal in thickness and length. The stripping spacer 726 and the upper and lower slide plates 720 and 722 include aligned holes 727 which receive bolts 728 to securely mount the stripping finger 718 to the extractor plate 702. The stripping bar 724 includes a pair of guide channels 730 cut therethrough and constructed to slidably receive check pins 732 which are affixed to one of the upper and lower slide plates 720 and 722. The guide channels are oval shaped with a longest axis extending in a direction parallel to the width of the stripping bar 724. The stripping bar 724 and spacer 726 include rectangular recesses 729 in the facing surfaces thereof to form a chamber which receives biasing springs 734. The front edge of each stripping bar 724 (FIGS. 21 and 22) includes an upper beveled edge 735 extending along a length of the top of the front edge 736 and a lower extraction ledge 738 extending along the bottom of the front edge 736.

The foregoing construction provides a stripping bar 724 having a front edge 736 which extends beyond the edge of the opening 716. The stripping bar 724 is linearly displaceable within a plane extending parallel to the top surface of the extractor plate 702 and perpendicular to the longitudinal axis of the mandrel 238. The stripping fingers 718 are positioned to extend beyond the edges of the opening 716 (FIG. 18) to form a smaller passage area therethrough. The springs 734 normally bias the stripping bar 724 outward. While biased outward, the passage area formed by the bars 724 is smaller than the outer diameter of the container, but greater than the outer diameter of the mandrel 238. The beveled upper edges 735 enable the front stripping bar 724 to be biased more easily outward (FIG. 21) over a container during extraction when the bars 724 contact the lower edge of the container.

The lower ends of the extractor shafts 704 (FIG. 14) are slidably received through slide bearings within holes through a bearing block 740. The bearing block 740 includes a bearing stand 741 bolted thereto that is fixedly attached to the frame 12. The bearing stand 741 has a length greater than the overall stroke of the extraction plate 702 to ensure that the lower ends of the extractor shafts 704 are never driven upward beyond the bearing block 740 or downward against the frame 12. The extractor shafts 704 project through and are fixedly secured to a drive block 742 (FIG. 13) at an intermediate point along a length of the shafts 704. The drive block 742 includes front and back halves 743 and 745 (FIG. 15), each of which includes concaved portions which meet in facing relation. The concaved portions engage the shafts 704 and are bound thereto via bolts 747. The drive block 742 is pivotally mounted on one side to a drive shaft 744 which is pivotally mounted to a driving lever 746.

Figure 14:
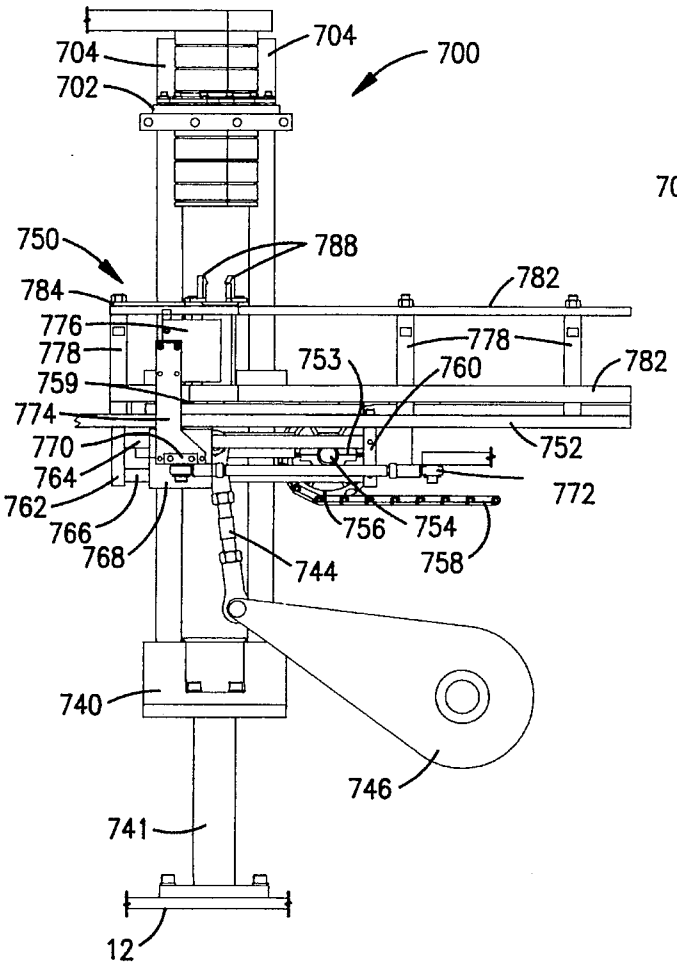
FIG. 14 is a side elevational view of the extraction mechanism while in an extended position.
Figure 13:
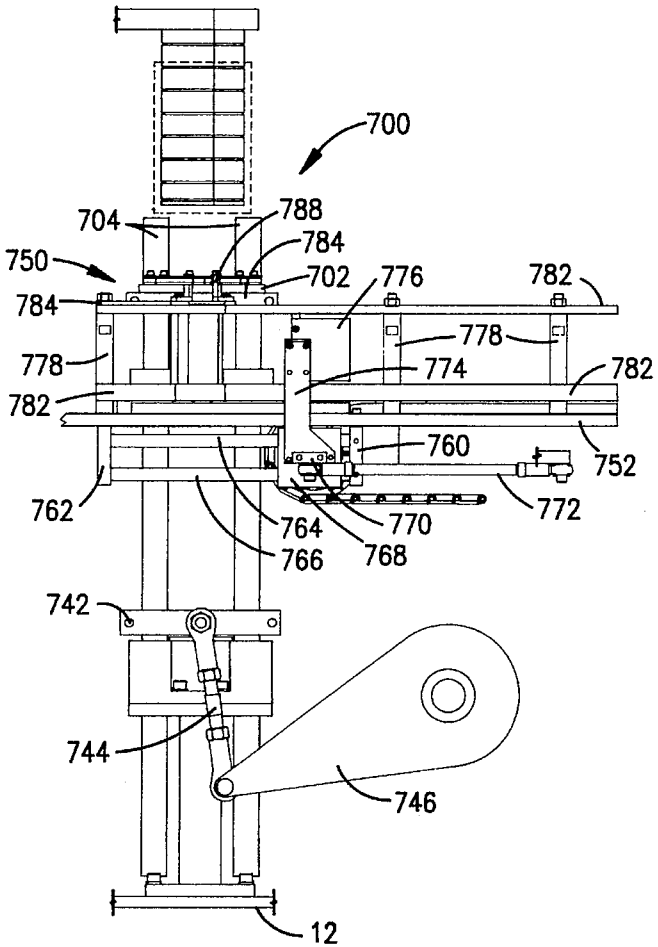
FIG. 13 is a side elevational view of the extraction mechanism while in a retracted position.

During operation, once the mandrel 238 transfers a container to the extraction station, the extraction assembly 700 physically removes the container from the mandrel 238. Initially, as the mandrel 238 is rotated to the extraction station, the drive shaft 744 and drive lever 746 are positioned, as illustrated in FIG. 13, in a retracted position. While retracted, the extractor shafts 704 are lowered to a position at which the upper ends thereof and the extraction plate 702 are below the mandrel 238 to allow rotary movement of same. Once the mandrel 238 is halted at the extraction station, the drive shaft 744 and drive block 742 are driven upward, thereby forcing the extractor shafts 704 upward along the rear end of the mandrel 238. As the shafts 704 rise, the extractor plate 702 similarly rises to receive, within the opening 716, the mandrel 238 and container (FIG. 14).

As noted above, the opening 716 is larger than the outer perimeter of the container, while the passage created within the front edges 736 of the stripping bar 724 is smaller than the perimeter of the container and larger than the perimeter of the mandrel 238. While the container thickness is quite small, the difference in the dimensions of the container and mandrel 238 is somewhat larger. This dimensional difference is owed to the fact that the mandrel does not snugly fit against the container at every point about its perimeter. Instead, the container tends to bulge or flare slightly, thereby separating from the mandrel 238 (most measurably proximate the center of each side of the mandrel 238). These separations afford a ledge about the top and bottom of the container.

Figure 16:
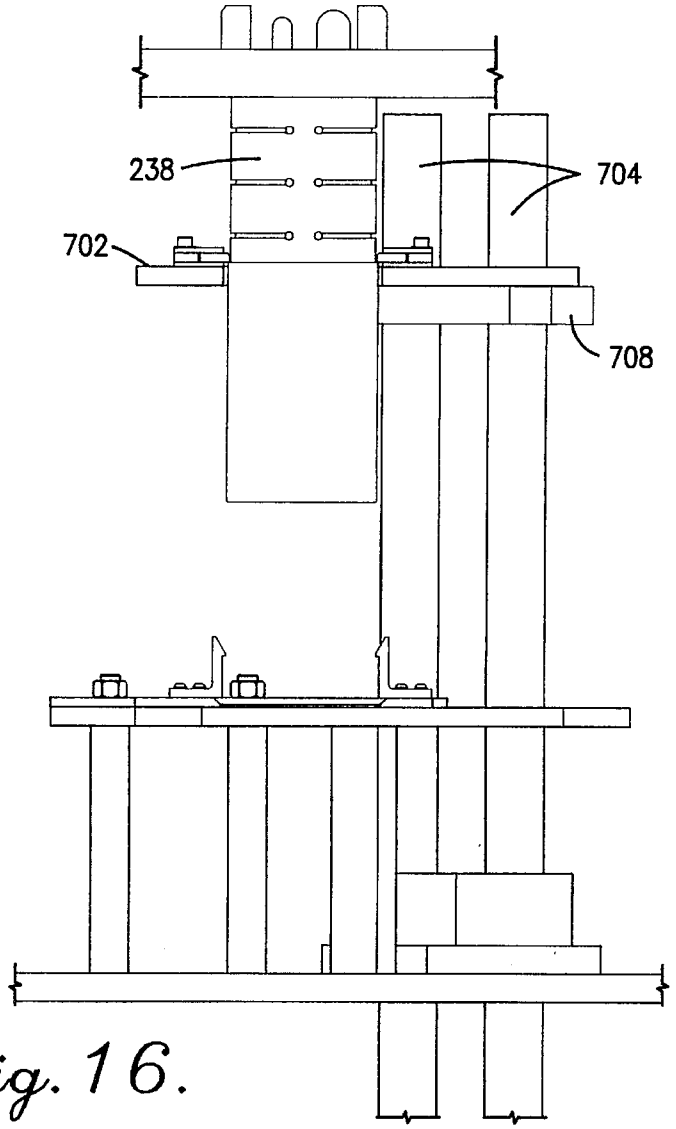
FIG. 16 is a fragmentary side view on an enlarged scale of the extraction mechanism while in an extended position.

As the extractor plate 702 rises upward against the lower edge of the container, the upper beveled edge 735 of the stripping bar 724 engages the lower edge of the container. The beveled edge 735 directs and biases the stripping bar 724 outward about the container. The springs 738 allow the bar 724 to move outward. As the extractor plates 702 pass up along the outer surface of the container, the stripping bars 724 remain biased against and in contact with the container (FIG. 21) until the stripping bar front edge 736 passes beyond the upper edge of the container (FIG. 16). Once the stripping fingers 718 clear the upper edge of the container, the stripping bars 724 are biased by the springs 734 inward (i.e. over the top ledge of the container as shown in FIG. 16) to a point immediately adjacent the mandrel 238. When outwardly biased, the front edges 736 of the stripping bars 724 do not pinch or bind against the mandrel, thereby preventing undue wear. Next, the drive lever 764 forces the shafts 704 and the plate 702 downward. The stripping bar lower extraction ledges 738 engage the top edge of the container as the extractor plate 702 is lowered. The biasing springs 734 prevent the stripping bars 724 from passing back over the container's top edge. The extractor plate 702 and the stripping fingers 718 manually pull the container downward off the bottom of the mandrel 238.

Figure 17:
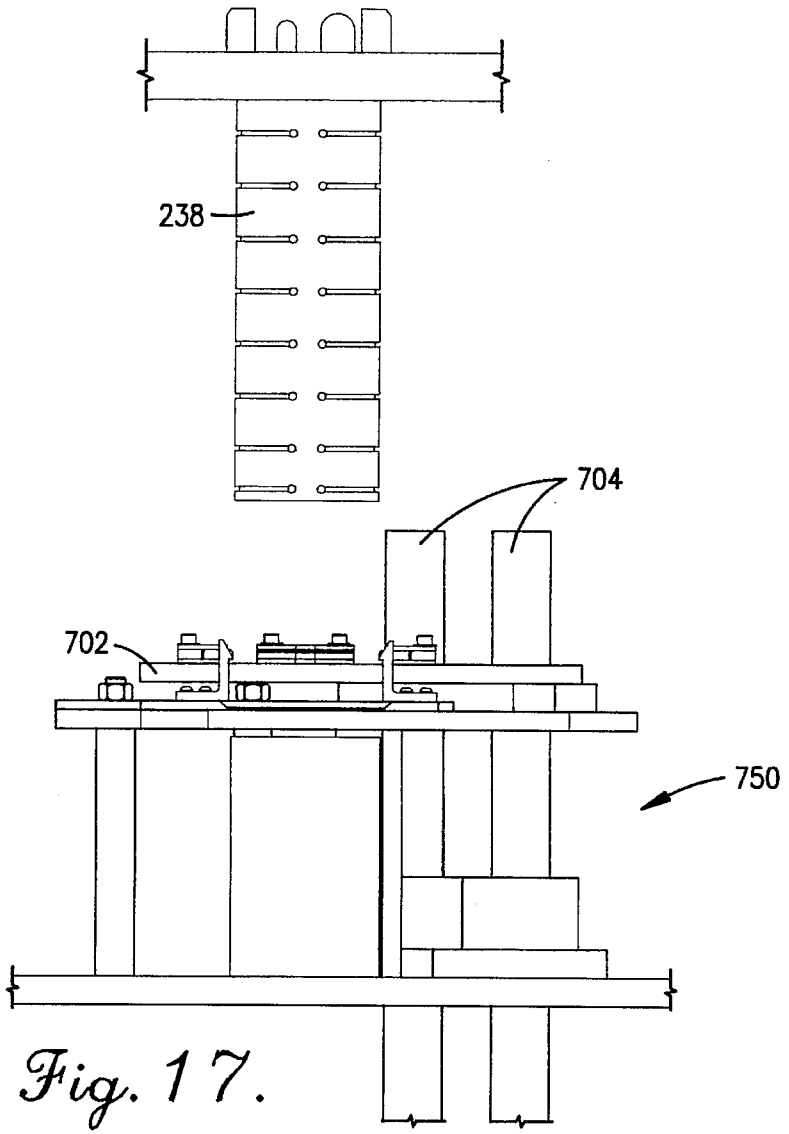
FIG. 17 is a fragmentary elevational view on an enlarged scale of the extraction mechanism while in a retracted position.
Figure 22:
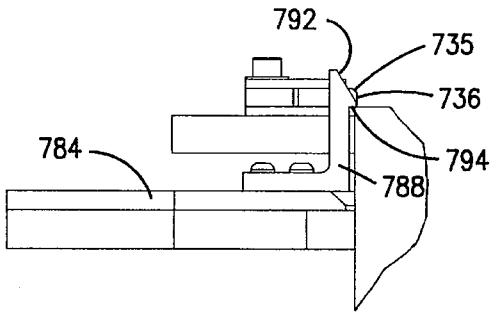
FIG. 22 is a fragmentary side view of a hook member disengaging a container from the extraction plate.

The opening 716 and the lower slide plate 722 are sufficiently close in diameter to the outer diameter of the container that the container and the extractor plate 702 remain in frictional engagement. Hence, once the container is pulled off of the mandrel 238, the container remains bound within the extractor plate 702. Thereafter, the extractor plate 702 is lowered to a transfer shuttle assembly 750 (FIGS. 17 and 22).

Figure 15:
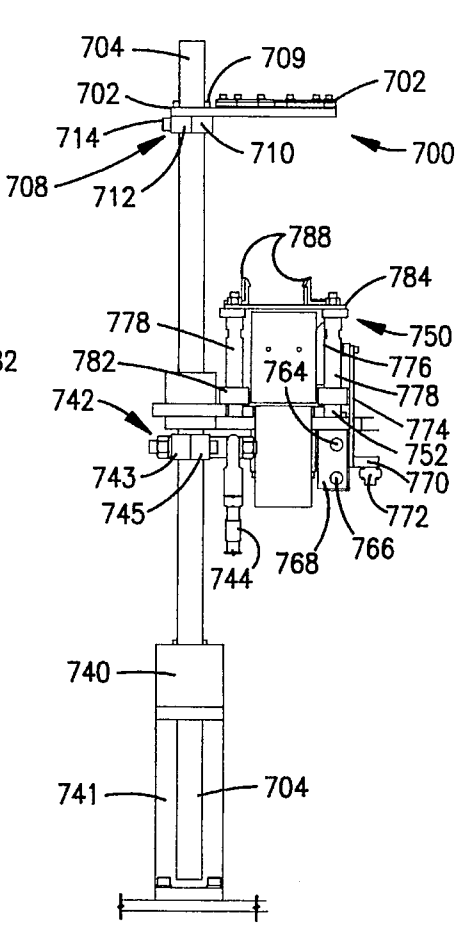
FIG. 15 is an end view of the extraction mechanism while in an extended position.
Figure 19:
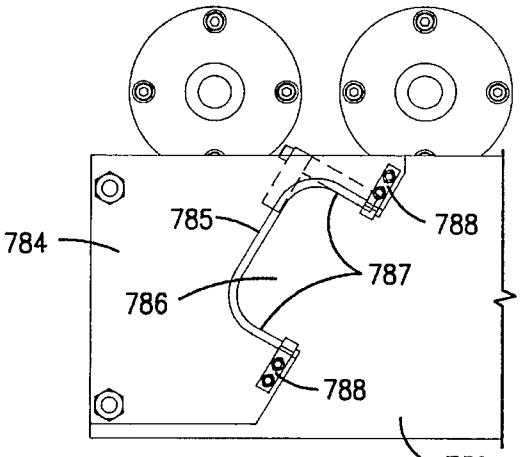
FIG. 19 is a fragmentary top planar view of the hook plate of the extraction mechanism.

Referring to FIGS. 13–15, the transfer shuttle assembly 750 is located proximate the extractor mechanism 700 and is used to further support the extractor shafts 704. The transfer shuttle assembly 750 includes a conveyor support 752 fixedly mounted at opposite ends to the frame 12. The conveyor support 752 is mounted to conveyor brackets 753 extending downward therefrom and arranged to rotatably support a conveyor shaft 754, upon which pulleys 756 rotate. The pulleys 756 include teeth which driveably engage links within the conveyor belt 758. The rear end of the belt 758 is immediately adjacent a transfer platform 759 (FIGS. 18 and 19). The bottom side of the conveyor support 752 is also secured to front and back slide rod holders 760 and 762 which project downward from the conveyor support 752. The front and back slide rod holders 760 and 762 support upper and lower transverse slide rods 764 and 766 which extend in a direction substantially parallel to the conveying path of the belt 758. The upper and lower transverse slide rods 764 and 766 are slidably received within linear bearings in bearing races through a slide block 768. The slide rods 764 and 766 are aligned such that the slide block 768 reciprocates along the conveying path. The slide block 768 is securely mounted to a shuttle bracket 770 (FIGS. 14 and 15) extending outward therefrom and connected to a drive rod 772. The shuttle bracket 770 includes a shuttle support 774 projecting perpendicular to the conveying plane and upward above the conveyor belt 758. The shuttle support 774 includes an upper end which is fixedly mounted to a L-shaped shuttle arm 776 projecting perpendicular to and traversing the conveying path.

The conveyor support 752 mountably receives, on its top side, a plurality of rail spacers 778 extending upward along either side thereof. The rail spacers 778 support top and bottom, left and right rails 782. The rails 782 interconnect with one another to form a channel-like box surrounding the conveyor belt 758 to direct a container along this path (FIG. 18) and to prevent the container from tipping. The rear ends of the top rails 782 support a stripping hook plate 784 (best illustrated in FIGS. 15, 19 and 22). The stripping hook plate 784 is constructed with a trapezoidal shape (FIG. 19) having an open faced recess 786 in its side closest to the belt 758, and directly above the transfer platform 759. The open faced recess 786 is provided with a contour substantially equal in shape and dimension to half of the opening 716 in the extractor plate 702. The recess 786 includes a rear end 785 and half-sides 787 which correspond to the rear end and rearmost half of the sides of the opening 716. The opening 716 and the open faced recess 786 are aligned at an angle to the conveying path (for instance, at a 45° angle with the longitudinal axis of the conveying path).

The hook plate 784 includes at least one hook member 788 located proximate one side of the open-faced recess 786. As illustrated in FIG. 19, hook members 758 are located proximate the half-sides 787 of the recess. The hook members 788 project upward and are formed with a beveled top surface 792 (FIG. 22) and a hooking ledge 794 proximate the outer end thereof.

The hooks 788 are aligned with square notches 737 cut through the centers of the front end of the stripping fingers 724. The notches 737 receive the hooks 788 therethrough as the extractor plate 702 lowers downward against the hook plate 784 (FIGS. 22 and 13).

Once the extractor plate 702 grabs the container and it is lowered, the container contacts the beveled surfaces 792 of the hooks 788. The hooks 788 and container deflect in opposite directions in order that the hooks 788 may pass by the container. The container continues traveling downward through the open faced recess 786 in the stripping hook plate 784. The extractor plate 702 is continually lowered until it is positioned immediately above the stripping hook plate 784. When in this juxtaposed position, the notches 737 are received downward over the hook members 788. The extractor plate 702 continues downward until the ledges 794 upon each hook 788 pass over and engage the top edge of the container. Once the hook members 788 are secured over the top edges of the container, the extractor plate 702 is pulled upward. The container becomes disengaged from the opening 716 in the plate 702. Once disengaged, the container falls onto the transfer platform 759 located immediately below the hook plate 784 and adjacent the end of the conveyor belt 758.

Prior to lowering the container through the hook plate 784, the drive rod 772 extends to slide the slide block 768 to a receiving position as illustrated in FIG. 13. When in the receiving position, the shuttle arm 776 is located to the left of the transfer assembly (as shown in dash lines in FIG. 18) thereby placing the transfer platform 759 between the shuttle arm 776 and the belt 758. Once the container falls onto the transfer platform 759, the shuttle arm 776 (which is located upstream of the container at this time) is pulled by the drive rod 772 across the transfer platform 796 (as shown in solid lines in FIG. 18). As the shuttle arm 776 moves in this manner, it drags the container off the platform 796, and onto the belt 758 between the rails 782 (FIG. 13). Thereafter, the shuttle arm 776 is returned to the receiving position while the conveyor belt 758 delivers the container to the next processing point and the foregoing process is repeated.

Alternative Embodiment

Figure 23:
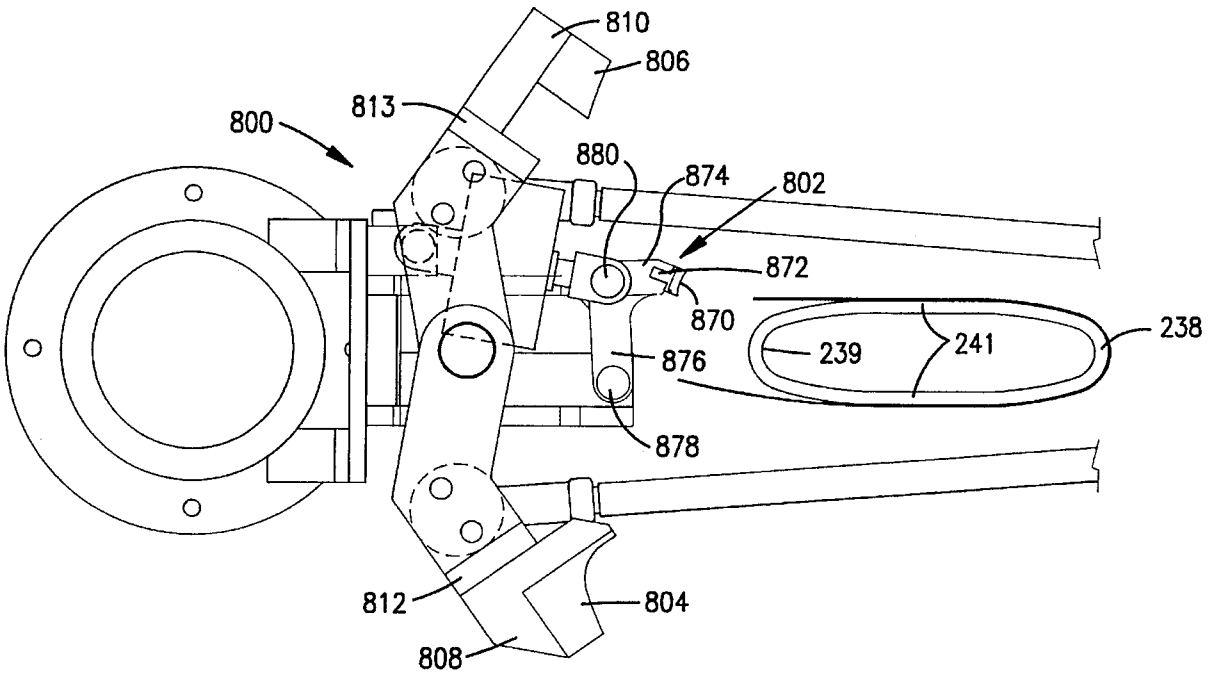
FIG. 23 is a top planar view of an alternative embodiment for the forward wing clamp assembly and the side seam clamp assembly while in a retracted position.
Figure 24:
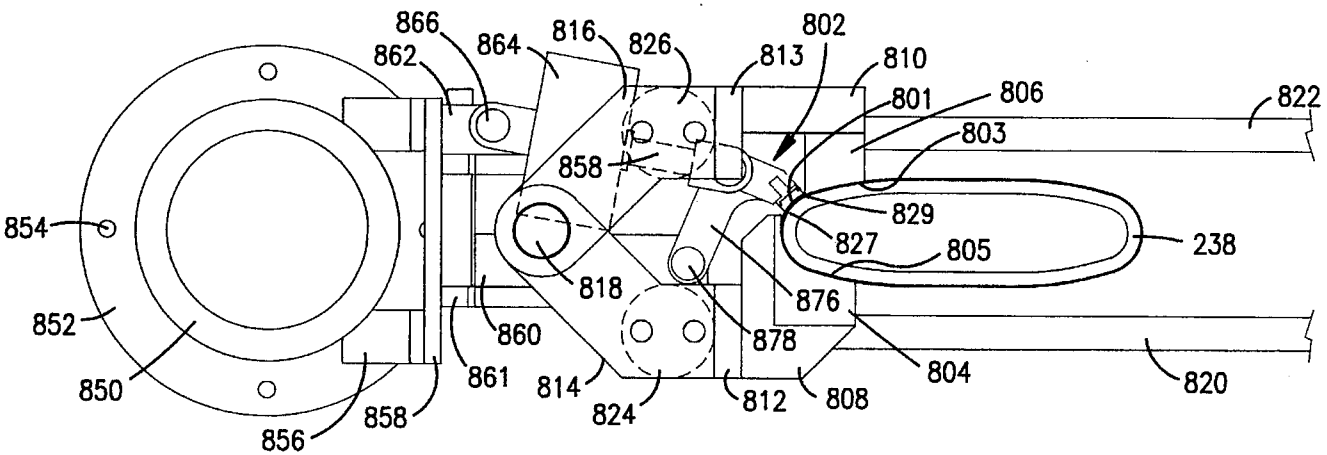
FIG. 24 is a top planar view of an alternative embodiment for the forward wing clamp assembly and the side seam clamp assembly while in an extended position.

FIGS. 23 and 24 illustrate an alternative embodiment for the forward wing clamp assembly (generally designated by the reference numeral 800) and the side seam clamp assembly (generally designated by the reference numeral 802). In this alternative embodiment, the seam between overlapping ends of the container blank has been rotated to a point upon the mandrel removed from the rear end thereof. As explained above, it is desirable to provide the seam at a point along the mandrel having a relatively large radius of curvature, in order to provide a flat seam.

The forward wing clamp assembly 800 is located proximate the rear end of the mandrel 238. This alternative clamp assembly 800 is preferably utilized when the mandrel 238 is constructed with a rear end 239 having an extremely small radius of curvature, while side sections 241 are constructed with a substantially larger radius of curvature. When it is desirable to construct containers having this shape, the seam 801 is rotated away from the rear end 239 of the mandrel 238 to a region of the side section 241 having a larger radius of curvature. The forward wing clamp assembly 800 generally resembles that of the first embodiment and includes primary and secondary wing pads 804 and 806 securely mounted upon primary and secondary wing pad braces 808 and 810, respectively. The pad braces 808 and 810 are mounted upon corresponding wing bars 812 and 813. The primary and secondary wing pads, braces and bars (804–813) are arranged to extend in a direction substantially parallel to the vertical axis of the mandrel 238. Upper and lower ends of the wing bars 812 and 813 are securely bolted upon outermost ends of each arm within sets of primary and secondary wing arms 814 and 816. The opposed ends of the primary and secondary wing arms 814 and 816 include holes therethrough which rotatably receive pivot pins 818.

As in the first embodiment, the pivot pins 818 are securely mounted within and project in opposite directions out of end caps which are secured to the top and bottom surfaces of the support frame. Set screws may be used to secure the end caps and the wing arms 814 and 816 to the pivot pins 818. These set screws facilitate changing of the forward wing clamp assembly 800 when changing the mandrel size and dimension. The lower wing arms 814 and 816, as in the first embodiment, are secured to drive rods 820 and 822 through primary and secondary connecting rods 824 and 826. The connecting rods 824 and 826 are secured through bolts to the wing arms 814 and 816 proximate the outer ends thereof. The drive rods 820 and 822 are pivotally mounted to the bottom ends of the connecting rods 824 and 826 via bolts.

During operation, the drive rods 820 and 822 reciprocate between an extended position (as illustrated in FIG. 23) and a retracted position (as illustrated in FIG. 24) to effect the scissor-like motion of the sets of primary and secondary wing arms 814 and 816. The drive rods 820 and 822 operate with substantially the same offset motion with respect to one another as utilized in the first embodiment, such that the set of secondary wing arms 816 rotates the secondary wing pad brace 810 toward the mandrel 238 slightly before the set of primary wing arms 814 rotates the primary wing pad braces 808 into contact with the mandrel 238. Hence, the secondary wing pad 806 engages the outermost portion of the right side of the container blank (i.e., the top side as viewed in FIGS. 23 and 24) slightly before the primary wing pad 804 engages the outermost portion of the left side of the container blank. In this manner, the outermost edge of the right side of the container blank falls against the mandrel 238 proximate the point identified by the reference numeral 827, while the outermost end of the left side of the container blank overlaps the right side end portion and falls proximate the reference numeral 829.

As illustrated in FIG. 23, the contacting surface 803 of the secondary wing pad 806 is afforded a contour which substantially follows that of the side section 241 of the mandrel 238, while the contacting surface 805 of the primary wing pad 804 is afforded a contour which substantially follows the end and side portions 239 and 241 of the mandrel 238.

A stationary support frame 850 includes a circular surrounding flange 852 upon its bottom end which is securely mounted, via bolts 854, to the frame 12. The support base 850 extends upward along a vertical axis in line with, but remote from, the rear end 239 of the mandrel 238. The support base 850 securely receives left and right support brackets 856 which securely support a face plate 858 extending upward along the length of the support base 850. Upper and lower support brackets 860 project horizontally outward from the upper and lower ends of the face plate 858. The support brackets extend toward the rear end 239 of the mandrel 238. The support brackets 860 receive the end caps and the pivot pins 818 on corresponding upper and lower surfaces, thereby supporting the forward wing clamp assembly 800. The face plate 858 further includes a piston brace 862 located horizontally upon the side of the face plate proximate the secondary wing arms and vertically between the upper and lower support brackets 860. The piston brace 862 pivotally supports the rear end of an air cylinder 864 via a hinge pin 866. The forward end of the air cylinder 864 receives a cylinder piston 868 which expands and contracts along a direction substantially in line with the mandrel 238. The support brackets 860 further include holes in the outermost ends thereof (closest to the rear end 239 of the mandrel 238) to pivotally support the side seam clamp 802. The side seam clamp 802 includes a pressure bar 870 which extends vertically along the seam 830 and is pressed thereagainst to assure that the heat and pressure will provide an effective seal at the seam. The pressure bar 870 includes rearwardly projecting lugs 872 which are received within recesses within a pressure bar support housing 874. The support housing 874 is formed integrally with L-shaped links 876 which are pivoted at pins 878 to the support brackets 860. The piston 868 of the air cylinder 864 is pivotally secured to one of the links 876 at 880 (proximate the bend therein).

The lugs 872 are separated from the housing 874 by resilient biasing means to absorb the impact force experienced when the cylinder 864 extends.

The support brackets 860 are supported on both sides thereof by side plates 861 which extend outward from the face plate 858 perpendicular thereto and substantially along a length thereof. The side plate 861 proximate the secondary side includes a cut out therethrough to afford room for the air cylinder 864 to be installed and operate.

Once the drive rods 820 and 822 successively rotate the primary and secondary wing arms 18 and 816 against the container link, thereby causing the primary and secondary wing pad 804 and 806 to fold the outermost ends of the container against the mandrel, the side seam clamp assembly 802 effects a sealing operation. In particular, the air cylinder 864 is activated to drive the piston 868 outward, thereby driving the links 876 forward about an arcuate path until the pressure bar 870 contacts the seam 830 and effects a seal.

In this alternative embodiment, the magazine, infeed turret 74, wing slide assembly 400 and the extractor mechanism 700 operate in substantially the same manner as those of the first embodiment. However, to align the container blank upon the mandrel 238 in the manner illustrated in FIG. 23, the container blanks are simply offset to one side within the magazine 20. As offset, the center line of each container blank is offset to one side of the leading edge of the mandrel 238. To effect this offset, the bolts securing the bars 28 (FIG. 1) to the magazine 20 are loosened and the magazine is slid to one side. This offset delivers the container blank to the suction cups 72 in an offset position. The mounting brackets 208 for the heaters are also shifted laterally along the rods 204 and 206 to align the heaters with the ends of the wall blanks. The remaining structure of the apparatus need not be changed.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. In a non-round container forming machine having means for receiving and delivering flat container wall blanks to a wrapping station, at which said blanks are wrapped around a non-round mandrel, having a front end facing said blank, said delivery means aligning said blanks substantially tangent to said mandrel when delivered to said wrapping station, the improvement comprising:

a wing slide assembly, within the wrapping station, proximate the front end of the mandrel which moves along a linear wiping path in close proximity to opposite sides of the mandrel, said wiping path being aligned in a direction substantially perpendicular to said blank, as delivered, to fold said blank along opposite sides of said mandrel;

a wing clamp assembly, within the wrapping station, proximate a rear end of the mandrel, which moves along a pivotal wrapping path within a horizontal plane to engage and direct outermost portions of opposite ends of said blank against the rear end and/or sides of the mandrel in an overlapping relation to form a side seam, said wing clamp assembly including primary and secondary wing arms each having a first end that is pivotally mounted to a hinge point located proximate the rear end of the mandrel and a second end upon which a wing pad is mounted, said wing pad extending vertically along a height of the blank for engaging and pressing portions of said blank against the mandrel and having an engaging surface conforming to the contour of a portion of the mandrel upon which the wing pad is to be pressed, wherein different sizes and shapes of wing pads may be mounted on the wing arms to conform to different sizes and shapes of mandrels;

means for driving the wing slide and wing clamp assemblies; and means for sealing overlapping edges of the blank to one another, while said wing slide assembly and said wing clamp assembly simultaneously hold and engage a substantial majority of the blank against the mandrel.

2. In a non-round container forming machine according to claim 1, the improvement further comprising:

a front clamp assembly, within the wrapping station proximate the front end of the mandrel, which moves to engage and press the blank against the front end of the mandrel; and a timed movement means for controlling and maintaining timed movement between the front clamp assembly and the wing slide assembly.

3. In a non-round container forming machine, according to claim 2, the front clamp assembly being pivotally mounted to move in a vertical plane about a pivot point to engage and press the blank against the front end of the mandrel and further comprising:

side support rails, having lower ends pivotally mounted at said pivot point, for rotation between blank engaging and disengaging positions, a facing pad aligned along a front side of said side rails to contact the container blank when said front clamp assembly is rotated to said engaged position, and at least one plunger mounted between the side rails and extending forward therefrom toward the mandrel to support the facing pad.

4. In a non-round container forming machine, according to claim 2, said timed movement means comprising a cam assembly having a timing control arm securely mounted to the front clamp assembly at a point above said pivot point, a cam follower attached to a rear end of the control arm, and a cam driving mechanism mounted to the wing slide assembly, said cam driving mechanism defining a path, along which the cam follower travels as the wing slide assembly moves from a retracted position to an extended position thereby allowing the front clamp assembly to rotate from a disengaged position to an engaged position.

5. In a non-round container forming machine, according to claim 1, the wing slide assembly further comprising:

a pair of wiper plates aligned parallel to and in facing relation with one another upon opposite sides of the mandrel, a base block which supports the wiper plates projecting vertically upward therefrom, and horizontal support shafts, aligned along said wiping path, which slidably receive said base block thereon, said drive means effecting reciprocating motion of said base block and said wiper plates along said support shafts.

6. In a non-round container forming machine, according to claim 1, the wing clamp assembly further including:

left and right connecting rods securely mounted to lower sides of corresponding left and right wing arms and extending downward therefrom, said connecting rods being pivotally secured to drive rods attached to said drive means which causes said drive rods to intermittently reciprocate along a substantially linear path between extended and retracted positions to effect pivotal movement of the left and right wing arms along the wrapping path.

7. In a non-round container forming machine, according to claim 1, said wing clamp assembly further comprising a shock absorber assembly mounted between and to limit motion of said wing pads, said shock absorber assembly including padded plungers aligned to receive cushion blocks extending forward from the wing pads, said cushion blocks engaging said plungers to halt inward movement of the wing pads.

8. In a non-round container forming machine, according to claim 1, the improvement further comprising:

an extraction assembly, within an extraction station, for engaging an upper edge of a container formed by said blank and for pulling downward on said container to remove said container from the mandrel.

9. In a non-round container forming machine, according to claim 8, said extraction assembly further including:

an extractor plate with an opening therethrough having an inner contour conforming substantially to the outer contour of the container formed on the mandrel, said extraction plate moving along a vertical path from a starting position below the mandrel upward to an extended position adjacent the upper edge of the container, at which said mandrel is received within said opening, and at least one stripping finger, located proximate said opening, to engage said upper edge of said container and to effect removal of the blank from the mandrel as the extractor plate lowers.

10. In a non-round container forming machine, according to claim 9, said stripping finger including upper and lower slide plates with a front stripping bar and a stripping spacer sandwiched therebetween, said stripping bar and said stripping spacer forming a chamber therebetween which receives a biasing spring to direct a front edge of the stripping bar outward toward said opening, said front edge including an upper beveled edge extending along a length of a top thereof to pass the container and including a lower extraction ledge extending along a bottom thereof to engage the container.

11. In a non-round container forming machine, according to claim 9, said extraction assembly including multiple stripping fingers positioned about a periphery of said opening and to extend beyond edges of said opening, said stripping fingers including biasing means which, while biased outward, forms a passage area smaller than an outer diameter of the container, but greater than an outer diameter of the mandrel.

12. In a non-round container forming machine, according to claim 8, further comprising:

a transverse shuttle assembly, located proximate the extraction assembly, to remove containers therefrom.

13. In a non-round container forming machine, according to claim 12, said transverse shuttle assembly including:

a conveyor belt for transferring containers from the extraction assembly to a next stage; and a stripping hook plate arranged immediately below the extraction assembly to remove a container from said extraction assembly, said hooking plate including an open-faced recess therethrough conforming in contour to a portion of the contour of said container.

14. In a non-round container forming machine, according to claim 13, said transverse shuttle assembly further including a transfer platform, immediately below the stripping hook plate, and a shuttle arm aligned to pull a container from the transfer platform onto a conveyor belt.

15. In a non-round container forming machine, according to claim 13, said stripping hook plate further including hook members located proximate at least one side of the open-faced recess, said hook members projecting upward and including a hooking ledge to engage an upper edge of said container.

16. In a non-round container forming machine, according to claim 1, wherein, said wing pad mounted to the primary wing arm having a blank engaging concave portion with a contour conforming to a part of a side of the mandrel and to a part of the rear end of the mandrel, and wherein said wing pad mounted to the secondary wing arm has a blank engaging concave portion with a contour conforming only to part of an opposite side of the mandrel, such that said primary wing pad wraps an outermost portion of the blank about a rear side portion and the rear end of said mandrel while said secondary wing pad folds an opposite outermost portion of the blank against a rear side portion of an opposite side of said mandrel to form an overlapping seam at a point along one side of the mandrel remote from the rear end thereof.

17. In a non-round container forming machine, according to claim 1, wherein said wing clamp assembly forms an overlapping seam from opposite ends of the blank at a point along a side of the mandrel remote from the rear end of the mandrel.

18. In a non-round container forming machine, according to claim 17, further comprising a side seam clamp assembly to effect a seal along an overlapping seam, said side seam clamp assembly including a pressure bar pivotally mounted upon links which pivot about a vertical axis between a position remote from the mandrel and a sealing position at which the pressure bar engages the overlapping seam located along one side of the mandrel.

19. In a non-round container forming machine having means for receiving and delivering flat container wall blanks to a wrapping station, at which said blanks are wrapped around a non-round mandrel having a front end facing said blank, said delivery means aligning said blanks substantially tangent to said mandrel when delivered to said wrapping station, the improvement comprising:

a wing slide assembly, within the wrapping station, which moves along a linear wiping path in close proximity to opposite sides of the mandrel, said wiping path being aligned in a direction substantially perpendicular to said blank, as delivered, to fold said blank along opposite sides of said mandrel;

an extraction assembly, within an extraction station, said extractor assembly comprising an extractor plate with an opening therethrough having an inner contour conforming substantially to the outer contour of the container formed on the mandrel, said extraction plate moving along a vertical path from a starting position below the mandrel upward to an extended position adjacent an upper edge of the container, wherein at least one stripping finger is located proximate said opening for engaging said upper edge of said container to effect removal of the container from the mandrel as the extractor plate lowers, means for driving the wing slide and extraction assemblies.

20. In a non-round container forming machine, according to claim 19, said stripping finger including upper and lower slide plates with a front stripping bar and a stripping spacer sandwiched therebetween, said stripping bar and said stripping spacer forming a chamber therebetween which receives a biasing spring to direct a front edge of the stripping bar outward toward said opening, said front edge including an upper beveled edge extending along a length of a top thereof to pass the container and including a lower extraction ledge extending along a bottom thereof to engage the container.

21. In a non-round container forming machine, according to claim 19, a wing clamp assembly, within the wrapping station, proximate a rear end of the mandrel, which moves along a pivotal wrapping path within a horizontal plane to engage and direct outermost portions of opposite ends of said blank against the mandrel in an overlapping relation to form a side seam.

22. In a non-round container forming machine having means for receiving and delivering flat container wall blanks to a wrapping station, at which said blanks are wrapped around a non-round mandrel having a front end facing said blank, said delivery means aligning said blanks substantially tangent to said mandrel when delivered to said wrapping station, the improvement comprising:

a forward wing clamp assembly, within the wrapping station, proximate a rear end of the mandrel, which moves along a pivotal wrapping path within a horizontal plane to engage and direct outermost portions of opposite ends of said blank against the mandrel in an overlapping relation to form a side seam, said forward wing clamp assembly including primary and secondary wing arms aligned in a plane of said wrapping path proximate a rear end of the mandrel, said wing arms having primary and secondary wing pads mounted thereon respectively, wherein said primary wing pad has a blank engaging portion with a contour conforming to a rear part of one side of the mandrel and to the rear end of the mandrel, and wherein said secondary wing pad has a blank engaging portion with a contour conforming only to a part of an opposite side of the mandrel, such that said primary wing pad wraps an outermost portion of the blank about the rear side portion and the rear end of said mandrel while said secondary wing pad presses an opposite outermost portion of the blank against a part of the opposite side of said mandrel to form an overlapping seam at a point along one side of the mandrel remote from the rear end thereof; and means for driving said forward wing clamp assembly.

23. In a non-round container forming machine, according to claim 22, further comprising a side seam clamp assembly to effect a seal along the overlapping seam, said side seam clamp assembly including a pressure bar pivotally mounted upon links which pivot about a vertical axis between a position remote from the mandrel and a sealing position at which the pressure bar engages the overlapping seam located along one side of the mandrel.

24. A method of forming non-round containers from flat wall blanks wherein the non-round container includes a side seam, comprising the steps of:

delivering each wall blank to a wrapping station proximate a front end of a non-round mandrel and aligned along a tangent of said front end;

clamping the blank, at an intermediate point therealong, to a front end of the mandrel;

wiping side sections of the blank, proximate the intermediate point, against opposite sides of the mandrel with at least one outermost end portion of the blank extending beyond the rear end of the mandrel;

folding at least one of the outermost end portions of the blank about the rear end of the mandrel until both end portions join to form an overlapping seam along one side of the mandrel by effecting pivotal movement of at least one wing arm pair wherein a first end of each arm is pivotally mounted proximate the rear end of the mandrel and a second end of each arm includes a wing pad contoured to conform to the contour of a portion of the mandrel, said pivotal movement thereby causing said wing pads to contract proximate the rear end of the mandrel and engage outermost portions of opposite ends of the blank and press the outermost portions of opposite ends of the blank against the mandrel to form a side seam along one side of the mandrel; and while engaging and holding a substantial majority of the blank against the mandrel simultaneously compressing the overlapping end portions to effect a seal on the side seam.

25. A method of forming non-round containers, according to claim 24, said clamping step comprising the steps of:

applying a clamping force to a front clamp assembly;

apply an opposite constraining force to said front clamp assembly to resist movement thereof and to prevent engagement with said blank until initiation of said wiper step; and releasing said clamping force automatically at a predefined intermediate point within said wiper step to allow said front clamp assembly to engage the blank.

26. A method of forming non-round containers, according to claim 24, wherein said wiper step includes the steps of:

linearly sliding a wiper assembly forward to engage said blank at points along both sides of said intermediate point in line with opposite side walls of the mandrel and holding side portions of the blank against the mandrel until a seal is effected.

27. A method of forming non-round containers, according to claim 24, further comprising the step of:

utilizing a cam mechanism to mechanically establish a timed relation between automatic initiation the clamping step and the wiping steps.

28. A method of forming non-round containers, according to claim 26, further comprising the steps of:

delivering said mandrel with a container formed thereon by the wall blank to an extraction station, positioning an extractor about the container formed from the blank proximate a top edge of the container, such that the extractor engages the top edge, and moving the extractor downward, while maintaining engaged relation between the extractor and the wall blank, in order to pull the wall blank downward off of the mandrel.

29. A method of forming non-round containers, according to claim 28, further comprising the steps of:

lowering the extractor and the container to a transfer position, engaging an upper edge of the container with hook members, and raising the extractor while the hook members engage the upper edge of the container to disengage the container from the extractor.

30. A method of forming non-round containers, according to claim 24, further comprising the steps of:

aligning an extractor plate, having a hole therethrough conforming to the contour of the container and mandrel, below the mandrel, raising the extractor plate, such that the mandrel and container are received within the hole, engaging stripping fingers located upon the extractor plate, over a top edge of the container, and lowering the extractor plate while the stripping fingers remain engaged with the container to disengage the container from the mandrel.

31. A method of forming non-round containers, according to claim 30, further comprising the steps of:

lowering the extractor plate into close proximity with a hooking plate having an open-faced recess therethrough conforming substantially in contour to a portion of the opening, continually lowering the extractor plate and the wall blank until hook members upon a top surface of the hook plate pass through recesses in the stripping fingers and engage the top edge of the container, raising the extractor plate while the hooking members retain the container to effect disengagement, and dragging the container onto a conveyor belt to be removed from the hooking plate.

32. A method of forming non-round containers, according to claim 26, wherein said folding step further comprises the steps of:

pivotally rotating primary and secondary wing pads into engagement with outermost portions of the wall blank in an offset relation, said primary wing pad folding an outermost portion of one side of the wall blank about an entire rear end of the mandrel, said secondary wing pad holding an outermost portion of an opposite side of the wall blank against a side of the mandrel proximate its rear end, and pivotally rotating a pressure bar into engaged relation with overlapping portions of the wall blank to effect a seal along one side of the mandrel remote from the rear end thereof.

33. A method of forming non-round containers, according to claim 24 further comprising the step of:

sealing overlapping outermost edge portions of the wall blank to one another at a point along one side of the mandrel remote from the rear end thereof and at a point along the mandrel having a radius of curvature substantially greater than the radius of curvature at the rear end of the mandrel.

34. A method of forming non-round containers, according to claim 24, wherein said delivery step positions the wall blank proximate a front end of the mandrel in an uneven relation such that a vertical center line of the wall blank is located to one side of the front end of the mandrel and wherein said wiping and folding steps wrap a larger length of the wall blanks around one side of the mandrel and the rear end thereof than an opposed side of the wall blank.

35. A method of forming non-round containers, according to claim 24, wherein said overlapping seam section is aligned along one side of the mandrel at a point therealong having a radius of curvature substantially larger than a radius of curvature proximate the rear end of the mandrel.

* * * * *